US007703464B2

(12) United States Patent
Ma

(10) Patent No.: US 7,703,464 B2
(45) Date of Patent: Apr. 27, 2010

(54) QUICK CONNECTOR FOR SHADE STRUCTURE

(75) Inventor: Oliver Joen-an Ma, 29 W. Wisteria, Arcadia, CA (US) 91007

(73) Assignee: Oliver Joen-an Ma, Arcadia, CA (US)

( * ) Notice: Subject to any disclaimer, the term of this patent is extended or adjusted under 35 U.S.C. 154(b) by 20 days.

(21) Appl. No.: 11/849,222

(22) Filed: Aug. 31, 2007

(65) Prior Publication Data

US 2009/0056776 A1 Mar. 5, 2009

(51) Int. Cl.
*A45B 25/06* (2006.01)

(52) U.S. Cl. ..... 135/29; 135/28

(58) Field of Classification Search ..... 135/28, 135/29, 30, 120.3; 403/150, 152, 153, 154, 403/157, 159

See application file for complete search history.

(56) References Cited

U.S. PATENT DOCUMENTS

| | | | | | |
|---|---|---|---|---|---|
| 501,089 | A | | 7/1893 | Lichtenstein | |
| 897,026 | A | | 8/1908 | Seitzinger | |
| 941,952 | A | | 11/1909 | Riehl | |
| 947,790 | A | | 2/1910 | Carter | |
| 1,469,495 | A | * | 10/1923 | Bunker | 135/29 |
| 2,321,495 | A | | 6/1943 | Levin | |
| 2,336,116 | A | | 12/1943 | Morando | |
| 2,385,575 | A | | 9/1945 | Isler | |
| 2,635,616 | A | | 4/1953 | Haydu | |
| 2,762,383 | A | | 9/1956 | Wittman | |
| 2,796,073 | A | | 6/1957 | Wittman | |
| 3,177,882 | A | * | 4/1965 | Militano | 135/28 |
| 3,462,179 | A | * | 8/1969 | Hinkle | 403/157 |
| 3,643,673 | A | | 2/1972 | Weber | |
| 3,704,479 | A | * | 12/1972 | Whitaker | 15/172 |
| 4,201,237 | A | * | 5/1980 | Watts et al. | 135/98 |
| 4,750,509 | A | * | 6/1988 | Kim | 135/135 |
| 5,193,566 | A | | 3/1993 | Chen | |
| 5,328,286 | A | * | 7/1994 | Lee | 403/218 |
| 6,311,706 | B1 | | 11/2001 | Sato | |
| 6,314,976 | B1 | | 11/2001 | Clarke | |
| 6,643,889 | B1 | * | 11/2003 | Kotlarski | 15/250.32 |
| 6,701,946 | B2 | | 3/2004 | You | |
| 6,705,335 | B2 | | 3/2004 | You | |
| 6,814,093 | B2 | | 11/2004 | You | |
| 7,178,535 | B2 | | 2/2007 | Eder | |
| 2004/0123891 | A1 | * | 7/2004 | Ma | 135/33.2 |
| 2005/0115599 | A1 | | 6/2005 | You | |
| 2007/0172310 | A1 | * | 7/2007 | Yang et al. | 403/150 |

* cited by examiner

*Primary Examiner*—David Dunn
*Assistant Examiner*—Danielle Jackson
(74) *Attorney, Agent, or Firm*—Knobbe Martens Olson & Bear, LLP

(57) ABSTRACT

A connector is provided to connect a structural rib of a structure to another rib or portion of the structure, such as an umbrella. The connector comprises first and second ends, and can include a reinforcing rib and/or a closure member. The second end comprises at least one recess extending from a side of the connector. The recess can comprise an open end configured to be coupled to a mounting member of an umbrella hub or rib and a closed end configured to rest on or retain the mounting member. The reinforcing rib can extend between the first and second ends of the connector to enhance its strength. The closure member, if present, can be biased to allow or restrict access to the open end of the recess to retain the mounting member in the closed ends thereof.

13 Claims, 14 Drawing Sheets

QUICK CONNECTOR FOR SHADE STRUCTURE

BACKGROUND

1. Field of the Inventions

The present inventions relate generally to interconnecting joints of shade structures (e.g. umbrellas and portable pavilions) having frames, and more specifically, to a uniquely configured connector that can be incorporated into frame members of such structures to enable quick and secure coupling of one member to another during the set up of such structures.

2. Description of the Related Art

There are a variety of shade structures, such as umbrellas and portable pavilions, that can be set up and taken down relatively quickly. Such structures are often mobile and very useful for certain activities, such as outdoor recreation. One of the primary benefits of these structures is that they can be mobile and thereby allow the user to quickly disassemble the structure, move its components to a desired location, and then re-assemble the structure at the desired location. Additionally, if not entirely disassembled, many of these structures can be repositioned or collapsed to assume a more compact state or configuration to facilitate storage and transportation of the structure.

In particular, large outdoor umbrellas and pavilions can be used to provide shade for persons sitting around tables. Such umbrellas can be very large, which can sometimes present difficulties during windy or other inclement weather. Pavilions similarly can be large and are also subject to large wind loads and other forces.

Additionally, these structures often require that the user reposition, take-down, or otherwise alter the configuration of the structure. However, even if these structures are to remain in a relatively permanent location, the set-up of these structures can often prove to be very difficult and labor intensive. Therefore, these structures must be configured to allow the user quick and secure assembly of the same.

Pavilions and umbrellas usually include a support structure and a canopy that is supported by the support structure. The support structure can include a frame. Because the frame generally includes a plurality of ribs, the assembly can take many steps. Sometimes, such structures require an extensive use of pins, bolts, and other fastening members that must be carefully placed at selected portions of the support frame when erecting the support frame.

For example, the support frame of a pavilion commonly requires that various members thereof be connected by using screws, bolts, cotter pins, and the like. In some cases, pavilions can be erected more quickly by expanding a compact, yet complex framework of hingedly connected members that expand outwardly and snap into place to create the pavilion. Even then, such structures often require that certain members be connected at various points of the structure to stabilize and secure the structure.

SUMMARY

An aspect of at least one of the embodiments disclosed herein is the realization that the connection devices used in the assembly of shade structures, such as pavilions and outdoor umbrellas, can be improved to provide a more secure, quicker, and more reliable connection. Such improved connections can be particularly advantageous for large shade structures which can sometimes be unwieldy. Another aspect of at least one of the embodiments disclosed herein is the realization that while some devices to expedite assembly have been suggested, such devices have been inadequate, for example lacking the ability to bear a full range of operational loads, which can be much higher than the weight of the components of the shade structure, particularly in windy conditions. As such, the members of a frame of a shade structure should be quickly, securely, and firmly interconnected so that the frame can properly support not only the weight of the various structural members and the canopy, but also the stresses and other forces that are common or possible during the use of such structures.

Therefore, an embodiment of a connector is disclosed herein that can facilitate the connection of a structural rib of a structure, such as an umbrella, to a hub or another rib of the structure. The connector(s) and the rib can be integrally formed from a continuous piece of material. Alternatively, the connector can be capable of being connected to one or both ends of the rib to facilitate the connection of the rib to another rib or the hub. Furthermore, it is contemplated that the connector can be made of one or a combination of any variety of available materials. For example, the connector can be made out of a durable plastic, metal, composites, or various combinations thereof.

In an embodiment, the connector can comprise a first end, a second end, and a closure member. The first end can be capable of being mechanically coupled with an umbrella rib, e.g., at an end of the umbrella rib. The first end of the connector can be integrally formed with the umbrella rib. Thus, the first end can include a portion of the connector disposed intermediate the second end of the connector and the umbrella rib.

In accordance with another embodiment, the second end can comprise a first recess extending from a side of a connector and a second recess extending from the side of the connector. Further, the second end can comprise a reinforcing rib separating the first recess from the second recess. Each of the recesses can comprise an open end and a closed end. The open end can be configured to be coupled to a mounting member of a hub. The open end can be configured to be coupled with the other rib, e.g., with a mounting member associated with the other rib. The closed end can be configured to rest on or retain the mounting member. The reinforcing rib can extend between the first and second ends of the connector for enhancing the structural strength of the connector.

Additionally, the closure member can be movable from a first position in which the open ends of the first and second recesses are exposed to permit the mounting member to enter the recesses to a second position in which the closure member can retain the mounting member in the first and second recesses. In some embodiments, the closure member can be movable along the side of the connector from which the first and second recesses extend.

In accordance with another embodiment, the connector can be configured such that the second end of the connector comprises a first recess extending from a first opening adjacent to a first side of the connector to a first shoulder located adjacent to a second side of the connector. The second end can comprise a second recess extending from a second opening adjacent to the first side of the connector to a second shoulder located adjacent to the second side of the connector.

Further, the second end of the connector can also comprise a reinforcing rib separating the first recess from the second recess. Thus, the first and second openings can be configured to receive a mounting member of another umbrella portion. The first and second shoulders can be configured to rest on or retain the mounting member. The reinforcing rib can extend between the first and second ends of the connector for enhancing the structural strength of the connector.

In some embodiments, the closure member can have a first end with a pair of fork members and a second end where the fork members converge. The fork members can be forwardly extending in that they are urged toward the second end of the connector, as discussed further below. The closure member can be movable from a first position, in which access to the first and second recesses is provided through the first and second openings, to a second position, in which the fork members extend across the first and second openings to thereby block access through the openings to the first and second recesses.

In accordance with another embodiment, an umbrella is provided that can utilize at least one embodiment of the connector in a frame of the umbrella. The umbrella can have an open position and a closed position, and can include a pole, a hub, a canopy support frame, and at least one connector. The hub can be configured such that it can be coupled with the pole and can have a mounting member. The canopy support frame can comprise a plurality of ribs. Each rib can have a first end disposed away from the pole, at least in the open position and a second end disposed adjacent to the pole.

The connector of the umbrella can comprise a first end, a second end, and a closure member. The first end of the connector can be coupled with the second end of one of the ribs. The second end can comprise a first recess, a second recess, and a reinforcing rib. The first recess can extend from a side of the connector, and the second recess also can extend from the side of the connector. The reinforcing rib can be configured to separate the first recess from the second recess. Further, each of the recesses can comprise an open end and a closed end, with the open end being sized to receive the mounting member of the hub and the closed end being configured to rest on or otherwise retain the mounting member. The reinforcing rib can extend between the first and second ends of the connector.

In some embodiments, the closure member can be movable along a side of the connector (e.g., the side of the connector from which the first and second recesses extend) from a first position to a second position. The closure member can cover the open ends of the first and second recesses in the second position and expose the open ends of the first and second recesses in the first position. In this regard, the closure member can be configured to move from the second position to the first position upon engagement with the mounting member of the hub, e.g., as the mounting member is moving through the open end(s) of the recesses into the recess(es) during assembly. Likewise, the closure member can be configured to move from the first position toward the second position when the mounting member disengages from the closure member, e.g., after the mounting member(s) is or are received in the recess (es) adjacent the closed end(s) or shoulder(s) thereof.

In another embodiment, a connector is provided that can be capable of connecting a first portion of a structure to another portion of the structure. The connector can comprise a first end capable of being mechanically coupled with the first portion and a second end comprising a recess that extends intermediate first and second sides of the connector. The recess can comprise an open end and a closed end. The open end can be configured to facilitate passage of a support post of the other portion of the structure toward the closed end of the recess. The closed end can be configured to rest on or retain the support post. The open end can define a first width and the closed end can define a second width to facilitate engagement or disengagement of the support post within the recess based on the general orientation and configuration of the support post.

Some embodiments can be configured such that the recess includes a channel section having a first width, which can be generally constant. Additionally, the second width can define a diameter of a perimeter of the closed end. In this regard, the second width can be greater than the first width.

It is also noted that the connector can optionally include a reinforcing rib and/or a closure member. For example, the connector can further comprise the reinforcing rib, which can separate the recess into first and second recesses. The reinforcing rib can extend between the first and second ends of the connector and connect the first end of the connector to the second end thereof for enhancing the structural strength of the connector. The connector can also comprise a closure member, which can be movable along the side of the connector from which the recess(es) that receive the mounting member can be accessed. The closure member can be movable from a first position, in which the open end of the recess is exposed to permit the support post to enter the recess, to a second position, in which the closure member retains the support post in the recess.

In yet another embodiment, a connector is provided that is capable of connecting a first portion of a shade structure to another portion of the structure. The connector can comprise a first end, a second end, and a closure member. The first end can be capable of being mechanically coupled with the first portion. The second end can comprise a recess and a reinforcing rib. The recess can extend from an opening adjacent to a first side of the connector to a shoulder located adjacent to a second side of the connector. The opening can be configured to receive a mounting member of the other portion of the structure. The shoulder can be configured to rest on or retain the mounting member. Further, the reinforcing rib can be located between the first and second ends of the connector and between the first and second sides of the connector for enhancing the structural strength of the connector.

The closure member can be disposed in the recess adjacent to the opening thereof. The closure member can be movable from a first position in which access to the recess is provided through the opening to a second position in which the closure member extends into the recess blocking access through the opening to the recess.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION

Figure 1:
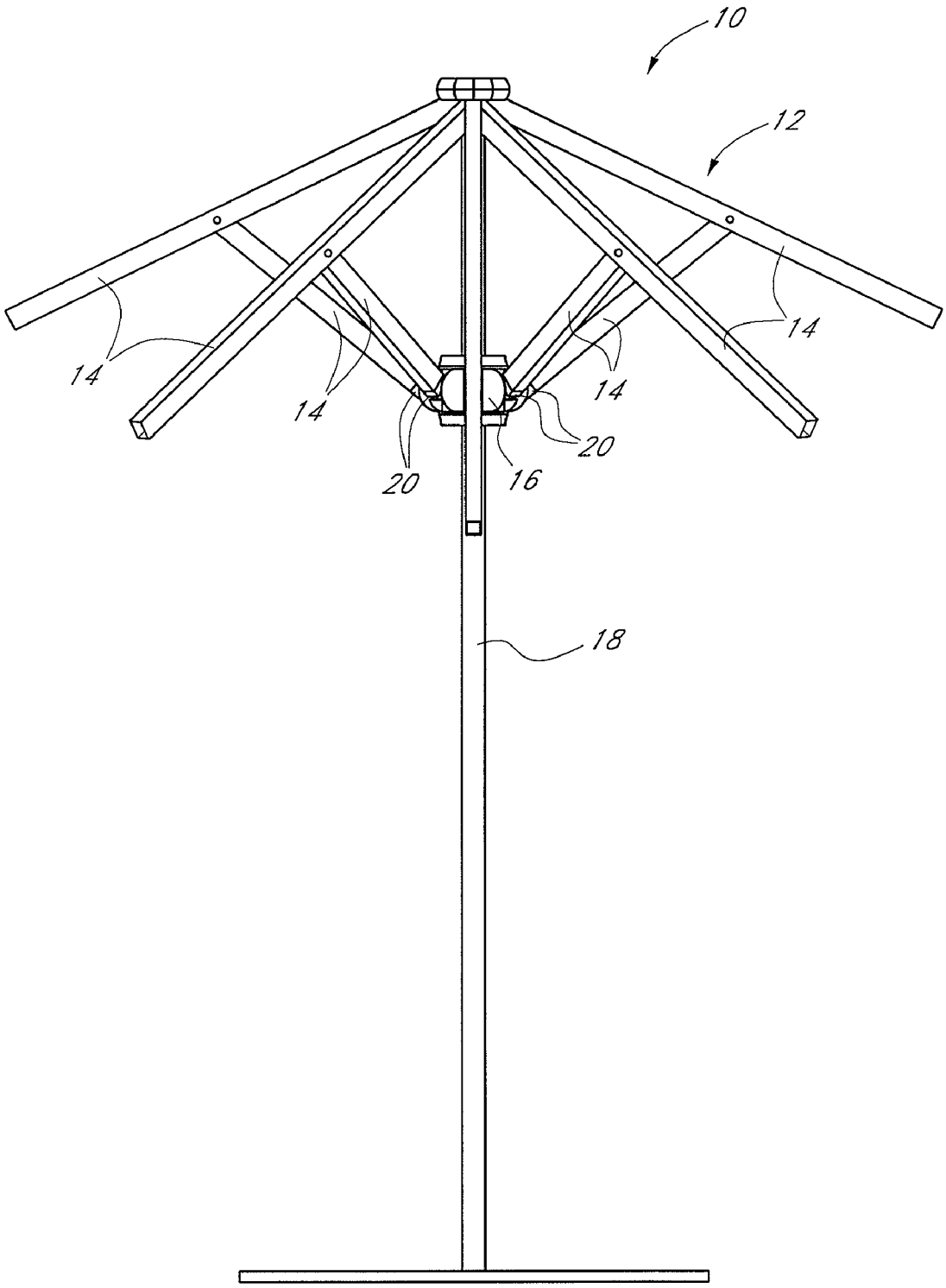
FIG. 1 is a side view of an umbrella having a pole, a hub, a canopy support frame, and a connector, according to one embodiment.

In accordance with an embodiment of the present inventions, there are provided various configurations of a connector that can be used with a structure, such as an umbrella or pavilion, to facilitate the rapid and secure fastening of structural ribs with a hub or other rib of the structure. As described in greater detail herein, the connector can incorporate various features such that a secure connection with a structure, such as a mounting member of a hub of an umbrella, can be obtained.

Further, the connector can also comprise certain features that enhance its structural stability and strength. In particular, such embodiments can provide various means for securing the connector to another rib, umbrella or pavilion hub, or other structure. It is contemplated that the embodiments that use such features can provide for a connector that is superior to prior art connectors used with umbrellas, pavilions, and other such structures. Further, it should be noted that the connector can be used with any variety of components and/or assemblies, including, but not limited to, umbrellas, pavilions, tables, display stands, and other load bearing structures that include interconnected members.

In accordance with an embodiment, the connector can comprise a first end, a second end, a reinforcing rib, and a closure member interposed between the first and second ends. In some embodiments, the first end can be coupled with an end of one of the ribs. In other embodiments, the first end of the connector can be integrally formed with one of the structural ribs or members, such that the connector and the rib are formed from a single, continuous piece of material.

Further, the second end of the connector can comprise at least one recess extending from a top or bottom region of the connector. Further, the connector can be configured such that the top or bottom region thereof forms at least a portion of the reinforcing rib, which can extend intermediate the first and second ends of the connector. In some embodiments, a portion of the reinforcing rib can be defined by or lie below a surface of the top region of the connector. The reinforcing rib can provide stability to the second end of the connector to support loads and stresses exerted thereon.

In accordance with some embodiments, a means is provided for securing the connector to the structure utilizing the geometry of the recess of the connector. In accordance with such embodiments, the recess of the connector can comprise an open end and a closed end. In an embodiment, the open end can be shaped as a slot, and can be of a constant-width. Further, the closed end can define a perimeter that is sized and shaped differently than the open end. In some embodiments, the open end has a width that is less than the width of the recess near the closed end.

For example, when used with an umbrella support frame, the open end of the connector can receive a mounting member of a hub of the umbrella therein. Further, the mounting member can be configured to define a unique cross-sectional geometry that can only be passed through the open end of the recess when generally aligned therewith. Thus, in such an embodiment, when the mounting member is received into the open end, passed through the recess to the closed end, and rotated relative to the connector, the mounting member can be captured within closed end of the recess. This capture of the mounting member can be achieved in some embodiments by positing the mounting member such that its widest dimension is not generally aligned with the open end of the recess. In some embodiments, this capture can be achieved by aligning the widest dimension of the mounting member generally transversely relative to a plane intersecting the open end of the recess and, in some cases, extending generally longitudinally through the recess. To disassemble the connector, the geometry of the mounting member can be generally aligned with that of the open end of the recess or of the longitudinal axis of the slot.

Thus, it is contemplated that the mounting member and the recess can be configured such that the mounting member is captured within the closed end of the recess upon relative movement, such as rotation, between the connector and the mounting member after the mounting member has been received within the closed end of the recess.

Furthermore, some embodiments of the connector can also comprise a closure member to provide an additional, e.g., a secondary, means for securing the mounting member within the recess. The closure member can be movable along the top region of the connector from a first position to a second position. The closure member is preferably configured such that in the first position, the open end of the recess is exposed and/or allows passage of the mounting member into the recess. Further, the closure member can be configured such that in the second position, the closure member covers and/or blocks the open end of the recess to reduce, prevent, and/or prevent removal of the mounting member from the recess.

In some embodiments, the closure member can be configured to move from the second position to the first position in response to engagement with the mounting member. The engagement between the mounting member and the closure member can occur as the mounting member is forced or pressed against a distal end of the closure member, e.g., an end of the closure member closest to the second end of the connector. Additionally, the closure member can be configured to rebound, in some embodiments, automatically, from the first position toward the second position. This can be facilitated by use of a biasing mechanism (e.g. a spring) which can be integrally or separately formed with the closure member. Further, it is noted that the movement of the closure member can be performed via translation, rotation, linear and/or non-linear movement.

It is also contemplated that the mounting member can pass through the recess using other than linear motion. For example, in other embodiments, at least one of the mounting member and the recess can be configured such that the mounting member passes through the recess in a curvilinear, multi-directional linear, and/or other types of motion, such that the mounting member passes from the open end of the recess to the closed end thereof.

FIG. 1 is a side view of an umbrella 10 having an umbrella canopy support frame 12 comprising a plurality of umbrella ribs 14. The umbrella 10 is shown as including a canopy C shown in dashed lines. The umbrella 10 can also comprise a hub 16 and a pole 18. The hub 16 can be slidably disposed on the pole 18 and can be interconnected with connectors 20 of the umbrella ribs 14. The umbrella ribs 14 are sometimes referred to herein as support ribs or structural ribs. Additionally, while the embodiments shown in the figures refer to an umbrella rib, other types of structural members can also be used. In this regard, the embodiments disclosed herein can be used not only with ribs or bar-like structural members, but also with plates, trusses, braces, joints, or other portions of a structure.

In some embodiments, as disclosed herein, the connector 20 can be configured to allow the rib 14 to be quickly and securely coupled to the hub 16. In this regard, it is noted that the umbrella 10 is not the only structure with which the connector 20 can be used. As noted above, the connector 20 can also be used with pavilions, and other shade structures, as well as tables, display stands, and other such structures that utilize interconnecting members, and in some instances, can be assembled into an expanded state from a collapsed state in order to make beneficial use of the structure. Therefore, although the connector 20 is illustrated as being used with the umbrella 10, the connector 20 can be used with any variety of other structures.

Figure 2:
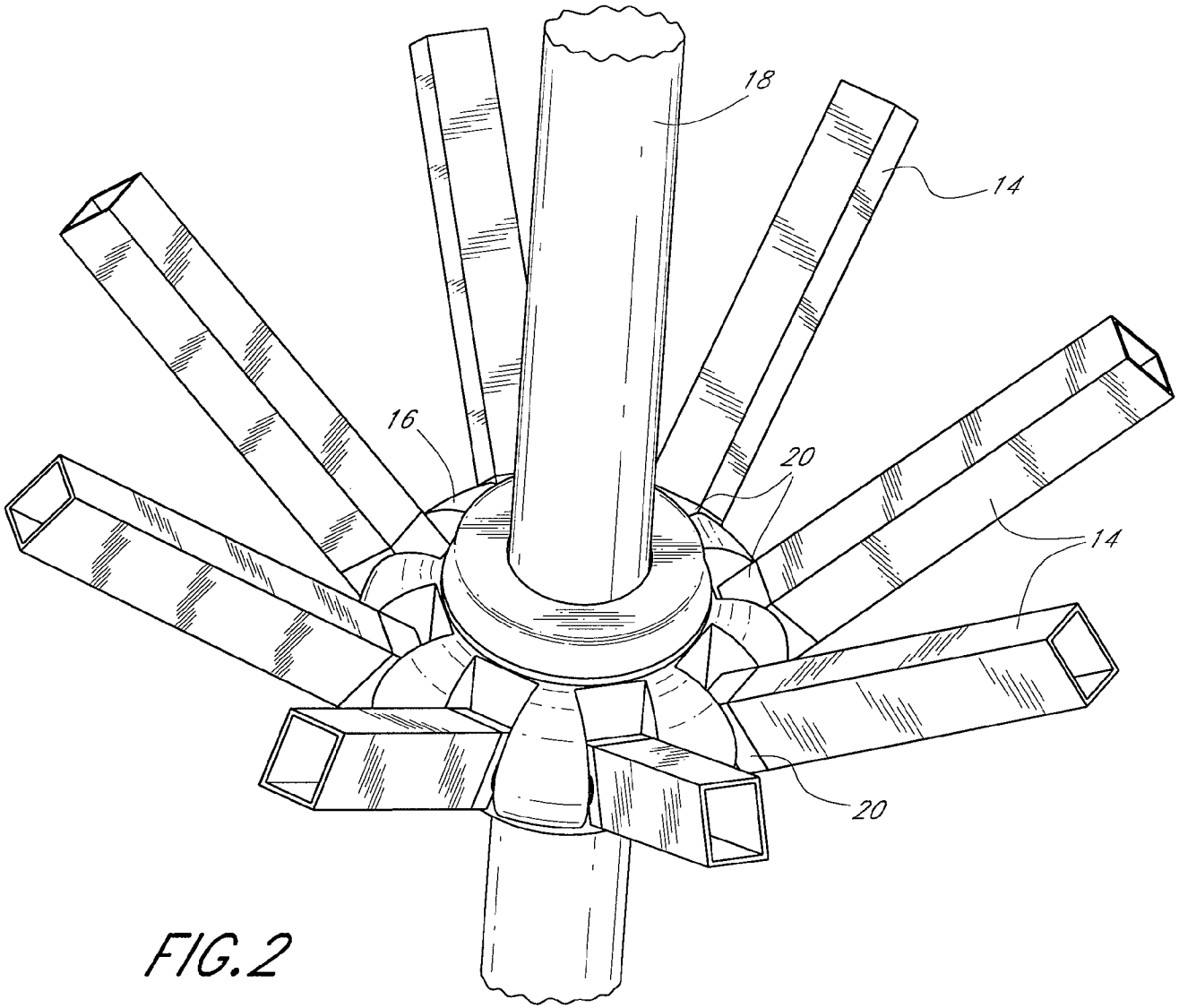
FIG. 2 is a detailed perspective view of the hub of the umbrella of FIG. 1 showing the connectors and the canopy support frame connected to the hub.

FIG. 2 is a detailed perspective view of the hub 16 and the plurality of support ribs 14 connected thereto. As discussed herein, the connectors 20 of the support ribs 14 can be configured to facilitate a rotatable connection with the hub 16. However, in other embodiments, it is contemplated that the connector 20 need not provide a rotatable connection with the hub 16 or another support rib 14. In this regard, the connector 20 can be used in some structures to provide a secure, rapid interconnection between respective members, which can result in a fixed relative orientation between such members. Nevertheless, as also discussed herein, the connector 20 can be configured to provide a secure engagement with another member which can allow relative motion between the connector and the member, such as rotational motion, linear motion, or otherwise.

Figure 3A:
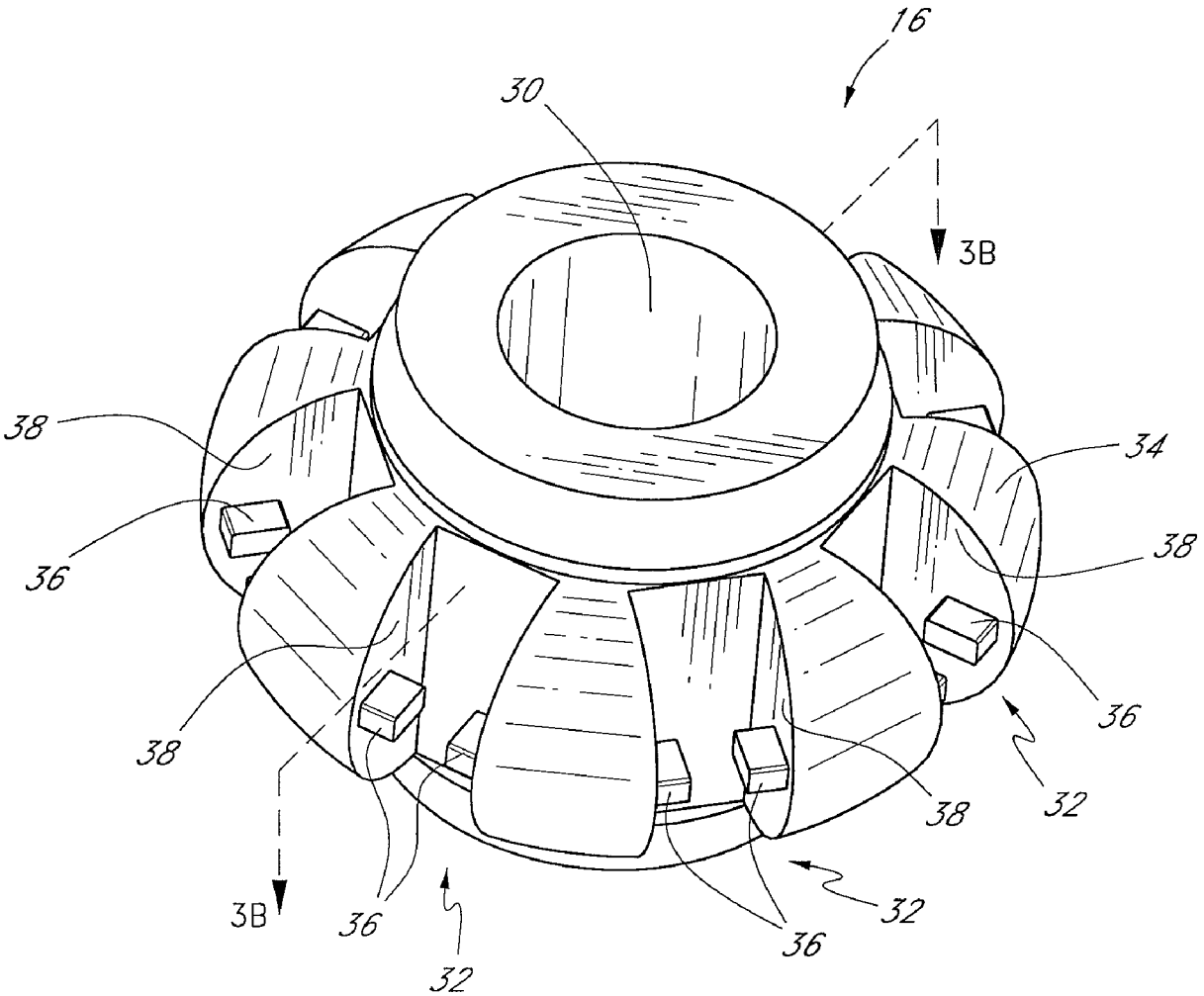
FIG. 3A is a perspective view of the hub of FIG. 2 illustrating mounting members configured to engage the connector and disposed on the hub.
Figure 3B:
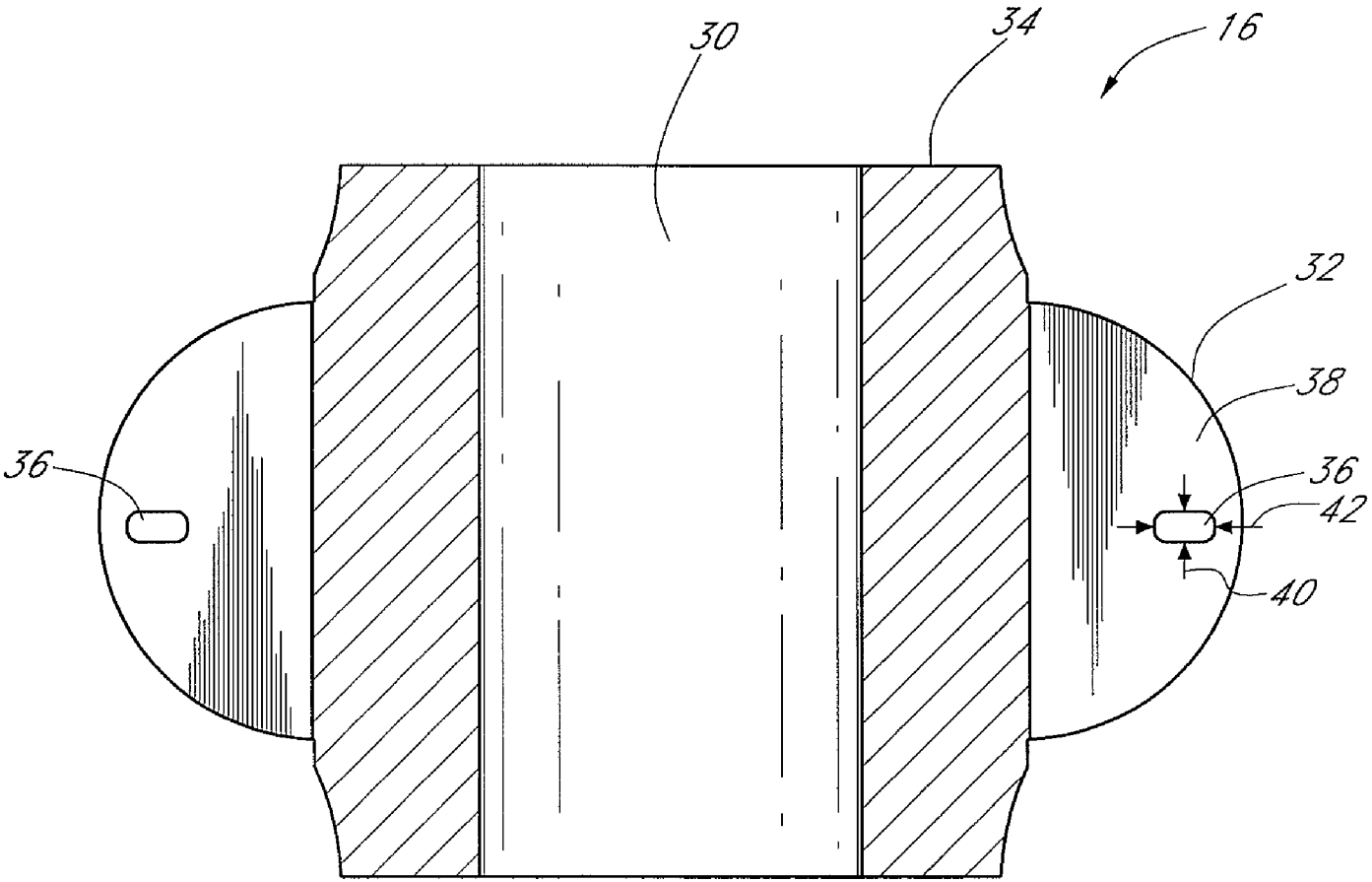
FIG. 3B is a cross-sectional view of the hub of FIG. 3A taken along lines 3B-3B, illustrating mounting members disposed thereon, the mounting members being configured to engage the connector.

Referring now to FIGS. 3A-3B, further details of the hub 16 are shown. As illustrated therein, the hub 16 can include a central aperture 30 wherein the pole 18 can be received (see FIGS. 1 and 2). Further, the hub 16 can include a plurality of engagement sections 32 extending radially outwardly from a body 34 of the hub 16. In the illustrated embodiment, the engagement section 32 of the hub 16 can further comprise one or more mounting members 36.

The mounting member 36 can be disposed along an interior surface 38 of the engagement section 32. In this regard, the mounting member 36 can protrude from interior surface 38, as illustrated in FIG. 3A. In some embodiments, the engagement section 32 can include a pair of mounting members 36 that protrude from interior surfaces 38 of the engagement section 32 and that can engage the connector 20.

In some embodiments, the mounting member 36 defines a substantially polygonal cross-section, such as a rectangular or other elongate cross-section. The mounting member 36 can define a rectangular cross-section having rounded corners. Thus, the mounting member 36 can define a cross-sectional height 40 and a cross-sectional width 42, as shown in FIG. 3B. However, the mounting member 36 can also be substantially circular in its cross-section or otherwise shaped. In some embodiments, the mounting member 36 can be oblong, e.g., having a first dimension that is greater than a second dimension transverse to the first dimension. In other embodiments, the mounting member 36 can have a cross-section that is rectangular with rounded edges, such as a rounded rectangle. Further, in yet other embodiments, the mounting member 36 can have a cross-section that is circular with a secant or chord of the circle defining a flat side thereof wherein a radius of the circle is greater than the distance from a midpoint of the chord and a point on the circle disposed along a line perpendicular with the midpoint. In yet other embodiments, the mounting member 36 can have a cross-section that is a rectangle whose top and bottom lengths are capped off with semicircles of a diameter equal to the height of the rectangle, e.g., an oval or stadium, as shown in FIGS. 8B-8D. Finally, in yet other embodiments, the mounting member 36 can have a cross-section defining various other detailed shapes.

Figure 4:
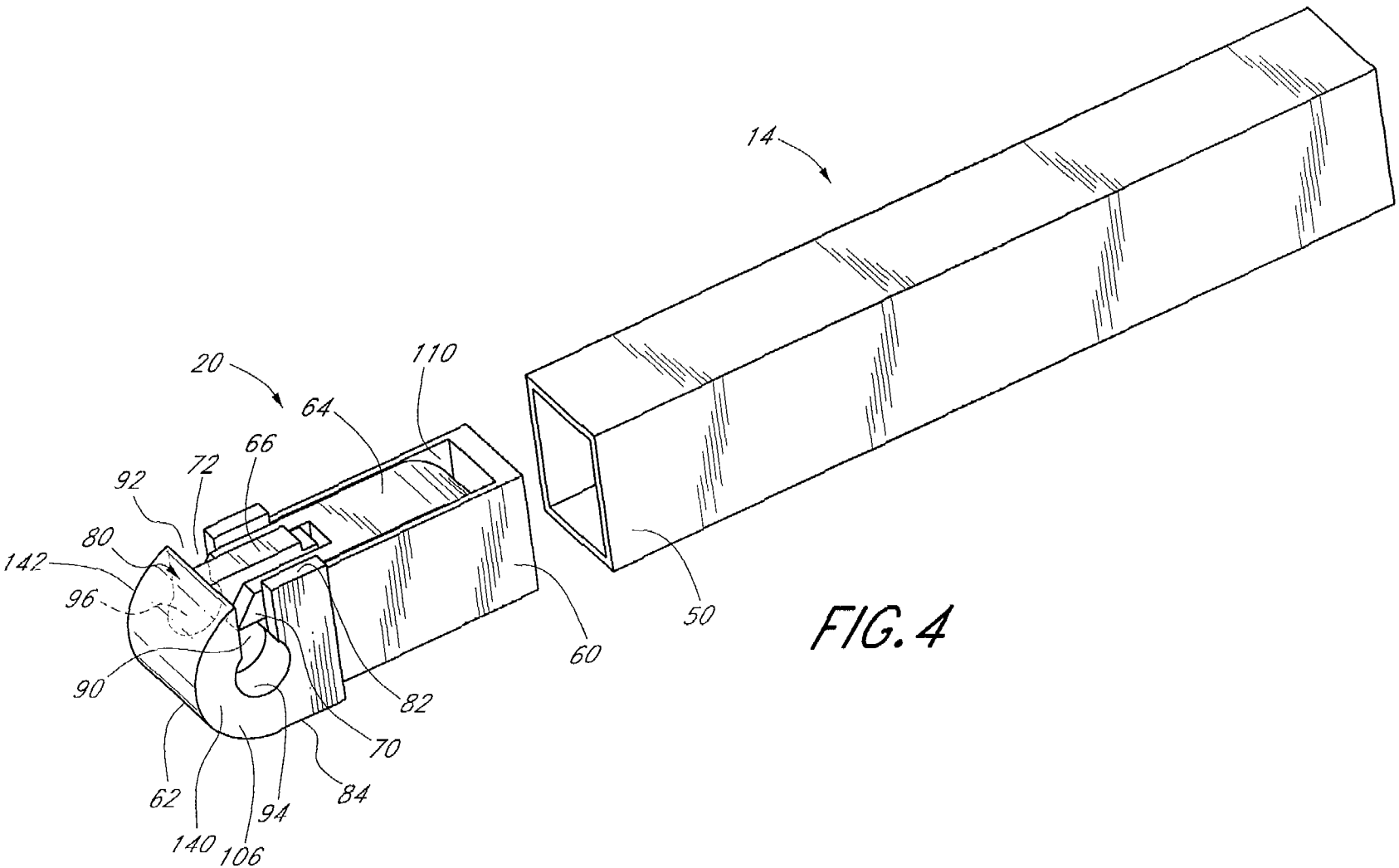
FIG. 4 is a perspective exploded view of a rib having a connector that can be coupled to an end thereof, in accordance with another embodiment.
Figure 5:
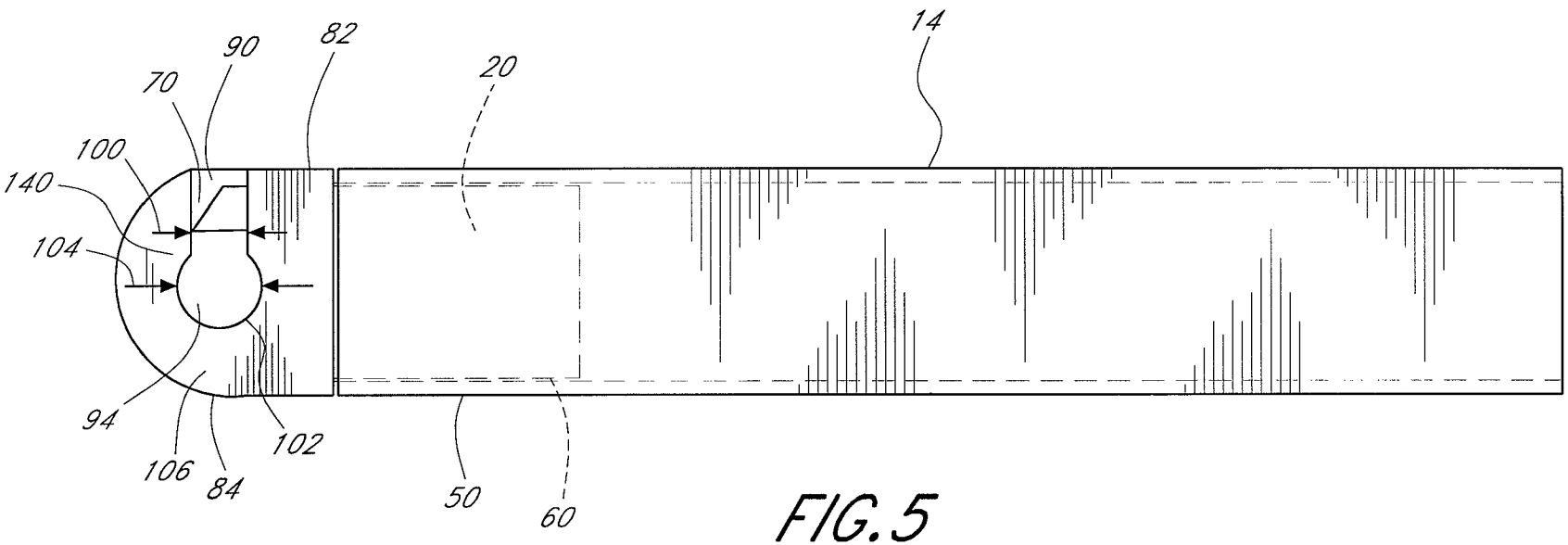
FIG. 5 is a side view of a rib having a connector coupled to an end of the rib, in accordance with an embodiment.

Referring now to FIG. 4, the connector 20 can be configured to be coupled to a second end 50 of the support rib 14. In this regard, the support rib 14 can be substantially hollow at least at its second end 50. Thus, the second end 50 can be configured to receive at least a portion of the connector 20. In the illustrated embodiment, a first end 60 of the connector 20 can be coupled with the second end 50 of the support rib 14, as shown in FIG. 5. The connector 20 and the support rib 14 in such embodiments can be connected using a press fit, pins, screws, adhesives or other configurations and elements known in the art to couple the connector 20 to the rib 14 at its second end 50.

As illustrated in FIG. 4, the connector 20 can be substantially polygonal in its cross-section. Thus, the support rib 14 and the connector 20 can define substantially rectangular cross-sections. However, it is contemplated that the cross-sections of the connector 20 and the support rib 14 can be of any shape, as desired.

The connector 20 can comprise the first end 60, a second end 62, a closure member 64, and a reinforcing rib 66. Some embodiments do not use one or either of the closure member 64 and the reinforcing rib 66. These features, and other aspects, are discussed further herein.

Referring still to FIG. 4, the connector 20 further comprises at least one recess, and in the illustrated embodiment, comprises a first recess 70 and a second recess 72. The first and second recesses 70, 72 can extend from a top region 80 of the connector 20. In some embodiments, the first and second recesses 70, 72 can extend from a top side 82 of the connector 20 toward a bottom side 84 of the connector 20. As illustrated, the first and second recesses 70, 72 can each respectively extend between open ends 90, 92 and closed ends 94, 96. The open ends 90, 92 of the respective ones of the first and second recesses 70, 72 can be configured to receive a respective mounting member 36 of the engagement section 32 of the hub 16.

The first and second recesses 70, 72 can each be configured, e.g., sized, such that the mounting member 36 can pass therethrough from the open ends 90, 92 toward the closed ends 94, 96 in order to facilitate a secure connection between the connector 20 and another structure, which is illustrated as a hub 16 in FIG. 2.

As shown in the side view of an embodiment in FIG. 5, the first recess 70 can comprise a substantially linear channel that extends from the open end 90 toward the closed end 94. The illustrated embodiment is one in which the channel is of a constant width. However, other embodiments can be configured such that the channel tapers (e.g. to a smaller width) towards the closed end. In other embodiments, the channel can include notches, a step-wise narrowing structure, and/or numerous other configurations. In the illustrated embodiment, the first recess 70 can define a first recess width 100 in a narrowed portion thereof, and the closed end 94 can define a closed perimeter 102. In the illustrated embodiment, the closed perimeter 102 can define a substantially circular shape having a diameter 104 that is greater than the recess width 100. In this manner, the mounting member 36 can be received into the first recess 70. As discussed below, the mounting member 36 can be captured within the closed perimeter 102 of the closed end 94 when the connector 20 is rotated relative to the mounting member 36. Thus, a device for securing the connector 20 to a structure that relies primarily on the geometries of the mounting member 36 and the first recess 70 can be provided.

For example, in an embodiment, the cross-sectional width 42 of the mounting member 36 can be greater than the recess width 100 of the first recess 70 and the cross-section of height 40 can be less than the recess width 100. Therefore, in order to insert the mounting member 36 into the first recess, the mounting member 36 must be longitudinally inserted into the open end 90 of the first recess 70, such that the cross-sectional height 40 can be received within the recess width 100.

Once the mounting member 36 passes through the open end 90 of the first recess 70 and reaches the closed end 94, the mounting member 36 can be freely rotated within the substantially closed perimeter 102 of the closed end 94. In such an embodiment, because the width diameter 104, e.g., of the closed perimeter 102 is greater than the cross-sectional width 42 of the mounting member 36, the mounting member 36 can be freely rotated relative to the closed perimeter 102 of the closed end 94. However, when the mounting member 36 is not longitudinally disposed relative to narrowed portion of the first recess 70, the mounting member 36 will be captured within the closed perimeter 102 of the closed end 94 because the cross-sectional width 42 of the mounting member 36 is greater than the recess width 100 of the narrowed portion of the first recess 70. In this regard, the mounting member 36 cannot be extracted from the first recess 70 unless it is appropriately generally aligned with the first recess 70.

In one embodiment, the orientation of the connector 20 relative to the structure to which it is coupled (e.g., the hub 16), when in an expanded, or set-up state, is such that the height 40 of the mounting member 36 is not aligned with the narrowed portion of the first recess 70. When the height 40 of the mounting member 36 and the narrowed portion of the first recess 70 are misaligned, their respective geometries prevent the connector 20 and hub 16 (or analogous structure) from being inadvertently disconnected. Further, it is noted that although reference has been made to the first recess 70 alone, any such reference should equally be applied to the second recess 72 or other recess, as applicable.

Referring to FIG. 4, the closure member 64 of the connector 20 can be disposed along the top region 80 of the connector 20. The closure member 64 can be moveable along the top side 82 of the connector 20 from a first position to a second position, in order to expose and cover the first and second recesses 70, 72. The first and second positions will be described in greater detail below.

As illustrated in FIG. 4, the closure member 64 can be disposed within a longitudinal slot 110 formed in the connector 20. In some embodiments, the closure member 64 can be configured to translate longitudinally in a substantially linear manner within the slot 110 so as to cover or expose, e.g. to block or allow access to, the open ends 90, 92, of the first and second recesses 70, 72. In addition, the slot 110 can be configured in some embodiments such that the closure members 64 can be seated therein with the second end 50 of the support rib 14 being placed thereover, as shown in FIG. 5.

Figure 6B:
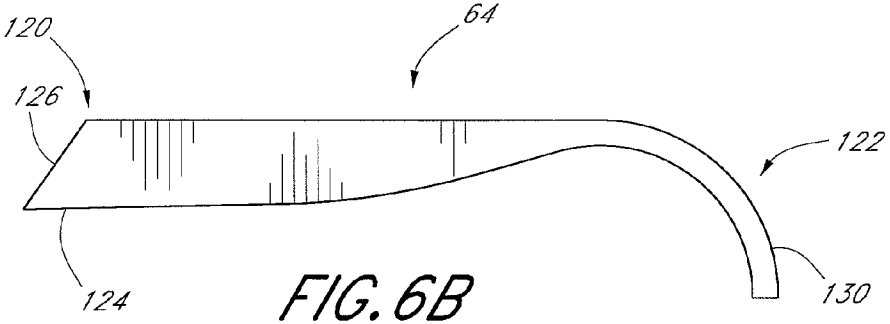
FIG. 6B is a side view of the closure member illustrated in FIG. 6A.
Figure 6C:
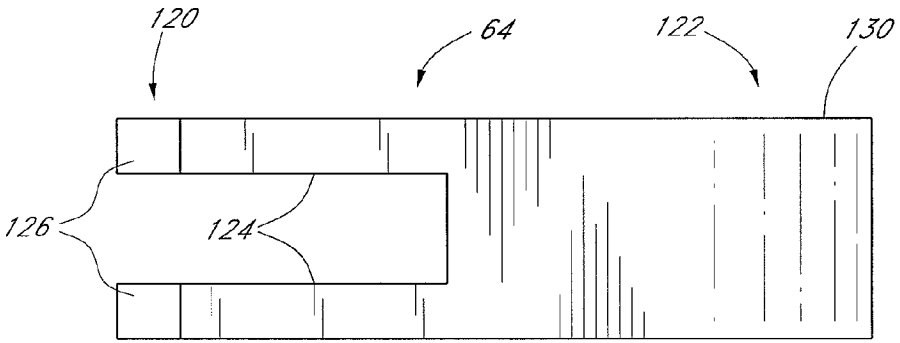
FIG. 6C is a top view of the closure member illustrated in FIG. 6A.
Figure 6A:
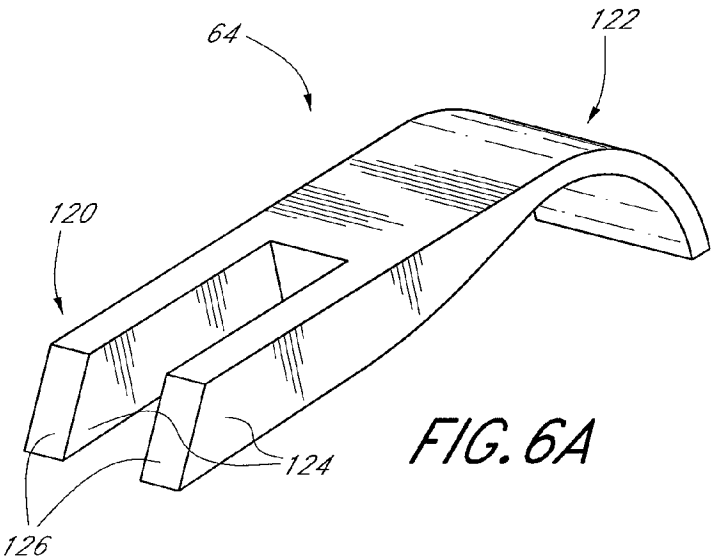
FIG. 6A is a perspective view of a closure member of the connector, in accordance with an embodiment.

Referring now to FIGS. 6A-6C, an embodiment of the closure member 64 is illustrated. FIG. 6A is a perspective view of the closure member 64 wherein the closure member 64 defines a first end 120 and a second end 122. At the first end 120, the closure member 64 can comprise a pair of forwardly extending fork members 124. The fork members 124 can be configured to cover the open ends 90, 92 of the respective ones of the first and second recesses 70, 72, when the closure member 64 is in the second position. For example, the fork members 124 can extend into or above the open ends 90, 92. Other configurations can be obtained using the present disclosure.

In addition, the fork members 124 can be configured to include engagement faces 126 that are configured to allow the mounting members 36 to engage with the closure member 64 such that the closure member 64 can be urged toward the first position to uncover or in some arrangements, to expose the open ends 90, 92 of the respective ones of the first and second recesses, 70, 72. In particular, the engagement faces 126 can be configured to define a slanted or arcuate geometry such that the closure member 64 tapers towards its first end 120 along the engagement faces 126 of the fork members 124. In this manner, a transverse motion of the mounting members 36 against the engagement faces 126 can cause a longitudinal translation of the closure member 64. This engagement and motion is described in greater detail below with reference to FIGS. 8A-8D.

As illustrated in the side view of FIG. 6B, an embodiment of the closure member 64 can include a resilient member 130, such as a spring element or a biasing element disposed at the second end 122 thereof. In this regard, when the closure member 64 is urged from the second position, the resilient member 130 can contact an interior portion of the slot 110 such that the resilient member 130 bends or compresses to resist the longitudinal movement of the closure member 64. Likewise, the resilient member 130 can serve to urge the closure member 64 back towards the second position. Thus, the resilient member 130 should be configured to fit within the slot 110 of the connector 20 and to urge the closure member 64 towards the second position.

The resilient member 130 can be configured as a leaf spring. In some embodiments, the resilient member 130 can be configured as spring, such as a coil spring or other resilient member. In other embodiments, other types of resilient members or configurations of various springs or biasing mechanisms can be incorporated into the connector 20 to serve as the resilient member 130.

The embodiment of the closure member 64 shown in FIGS. 6A-6C illustrates the resilient member 130 as being integrally formed and continuous with the closure member 64. However, the resilient member 130 can also be formed separately from the closure member 64. In this regard, the resilient member 130 can be attachable to the closure member 64, or can simply interact with the closure member 64 without being attached thereto.

Additionally, referring now to the top view of the closure member 64 shown in FIG. 6C, the fork members 124 of the closure member 64 can be appropriately spaced such that the reinforcing rib 66 can be positioned therebetween when the closure member 64 is seated on the connector 20. As mentioned herein, the illustrated embodiment of the closure member 64 and the connector 20 are not limiting of the inventions and embodiments disclosed herein. Instead, it should be noted that the closure member 64 can comprise a single, undivided first end 120 that can pass above the reinforcing rib 66. In this regard, the reinforcing rib 66, as discussed further below, can be configured to be spaced sufficiently far from the top side 82 of the connector 20 to facilitate that passage of the closure member 64 thereabove while still providing structural stability and strength to the connector 20.

Figure 7:
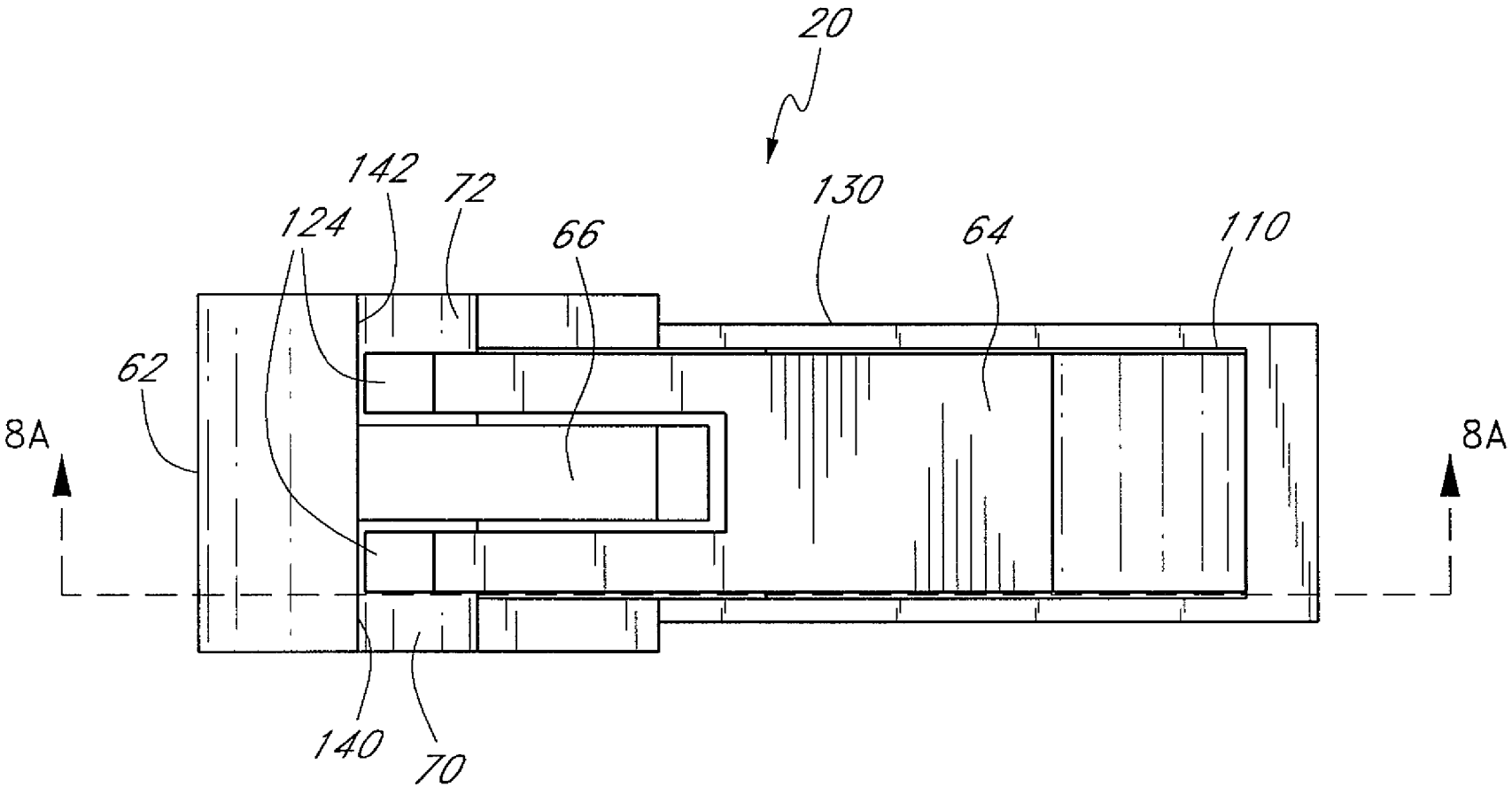
FIG. 7 is a top view of the connector illustrated in FIG. 4.

FIG. 7 is a top view of the connector 20 illustrated in FIG. 4. As shown therein, the closure member 64 can be disposed within the slot 110 of the connector 20. Additionally, the reinforcing rib 66 can extend upwardly between the fork members 124 of the closure member 64. In this embodiment, the reinforcing rib 66 connects the second end 62 of the connector 20 with a central portion 130 of the body of the connector 20. This is also illustrated in the side cross-sectional views of FIGS. 8A-8D. The structural significance and advantage of such an embodiment is described further herein.

As also shown in FIG. 7, the connector 20 can define a first shoulder 140 and a second shoulder 142. In the illustrated embodiment, the first and second shoulders 140, 142 can be considered as that portion of the connector 20 disposed intermediate the respective ones of the first and second recesses 70, 72 and the second end 62 of the connector 20. Thus, the first and second recesses 70, 72 can at least partially define a rear boundary of the respective ones of the first and second shoulders 140, 142. Further, the second end 62 of the connector 20 can at least partially define a forward boundary of the first and second shoulders 140, 142. Thus, the first and second shoulders 140, 142 can represent that portion of the connector 20 that protrudes laterally and whose rear boundary defines at least a portion of the first and second recesses 70, 72. As shown, the first and second shoulders 140, 142 can also be configured to extend upwardly from the bottom side 84 of the connector 20 from an elbow section 106 of the connector 20.

It is noted that when the mounting members 36 are received within the respective ones of the first and second recesses 70, 72 various types of stresses and forces can be exerted upon the connector 20 by the mounting members 36. In particular, the mounting members 36 can tend to exert a force upon the first and second shoulders 140, 142 in the direction of the second end 62 of the connector 20.

This type of force can create a bending moment that could damage a less advanced umbrella structure which could fail when a significant force is exerted by a mounting member on a rib or connector. Some embodiments of the connectors disclosed herein can be configured to include a reinforcing rib to increase their strength such that all of the forces exerted on the connector do not result in a critical load or excessive bending moment at the second end of the connectors. This prevents the connectors from breaking during normal loading. In a normal, but high loading condition a less advanced connector could bend or snap if the elbow section 106 were urged outwardly away from the body of the connector. Therefore, although the reinforcing rib 66 is not essential to some embodiments, the reinforcing rib 66 can be used to increase the load-bearing capacity and strength of the connector 20.

When a high, but normal load is exerted against the first and second shoulders 140, 142, the force can be distributed through the body of the connector 20 via the reinforcing rib 66. Therefore, the elbow section 106 of the connector 20 will not tend to experience a failure-inducing bending moment as could occur in a less advanced design. Instead, the reinforcing rib 66 is able to strengthen and reinforce the connector 20 such that any forces exerted upon the first and second shoulders 140, 142 do not result in failure at the elbow section 106 of the connector 20.

Figure 8A:
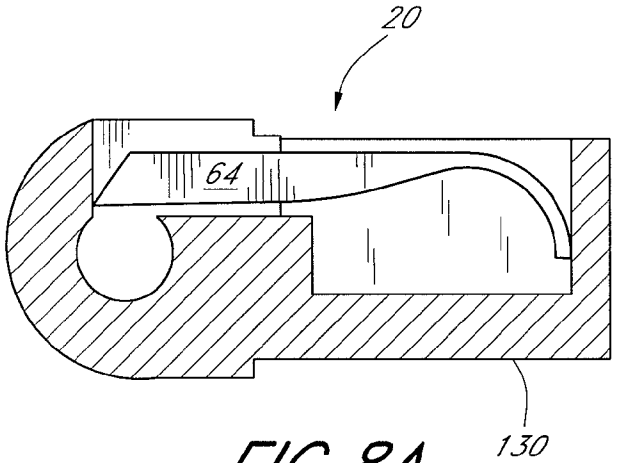
FIG. 8A is a side cross-sectional view of the connector illustrated in FIG. 7.
Figure 8B:
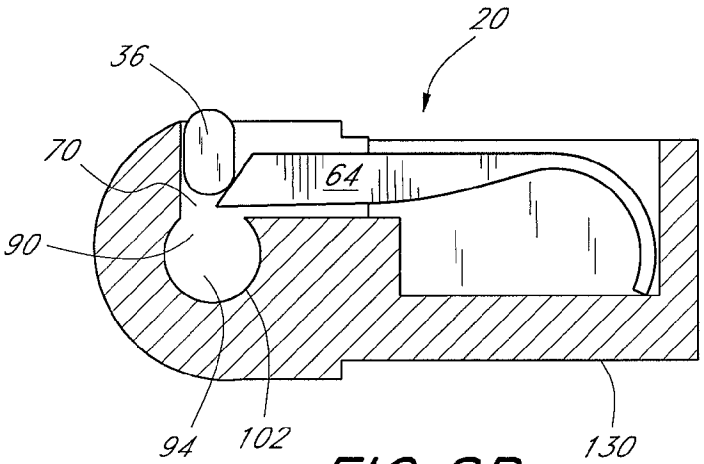
FIG. 8B is a side cross-sectional view of the connector illustrated in FIG. 8A wherein a mounting member of a hub is shown engaging the closure member of the connector, in accordance with an aspect of an embodiment.
Figure 8C:
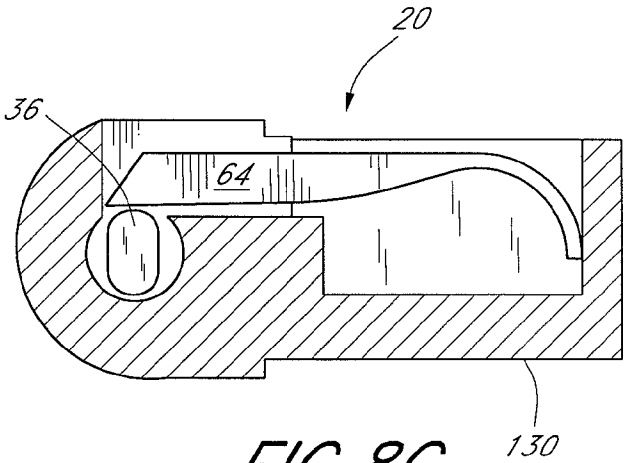
FIG. 8C is a side cross-sectional view of the connector illustrated in FIG. 8A wherein the mounting member is illustrated as having disengaged the closure member of the connector and is received within a recess of the connector, in accordance with another aspect of an embodiment.
Figure 8D:
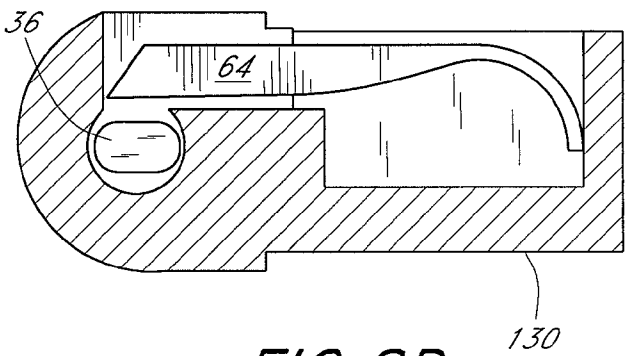
FIG. 8D is a side cross-sectional view of the connector illustrated in FIG. 8A wherein the connector has been rotated relative to the mounting member with the mounting member being received within a recess of the connector, in accordance with another aspect of an embodiment.

Referring now to the FIGS. 8A-8D, various cross-sectional views of the connector 20 are provided. In these illustrations, the closure member 64 of the connector 20 is shown in the first and second positions. For example, FIG. 8A shows the closure member 64 of the connector 20 in the second position. FIG. 8B illustrates relative motion between a mounting member 36 and the connector 20 such that the mounting member 36 enters the first recess 70. As mentioned above, such movement causes the mounting member 36 to engage the closure member 64, which causes the closure member 64 to slide longitudinally or translate linearly from the second position toward the first position. When in the first position, the closure member 64 exposes and/or provides access to the open end 90 of the first recess 70. In other embodiments, such engagement could cause rotational movement of the closure member 64.

Once the mounting member 36 passes through the first recess 70 and enters the closed perimeter 102 of the closed end 94, the closure member 64 can rebound, move, or return toward the second position. Thus, the closure member 64 can cover and/or block access to the open end 90 of the first recess 70. Accordingly, as shown in FIG. 8C, the closure member 36 is then captured within the closed perimeter 102 of the closed end 94. When this occurs in this embodiment, the closure member 64 prohibits the mounting member 36 from exiting the first recess 70.

However, even though the closure member 64 can be used to block access to or from the first recess 70, certain forces can be exerted by the mounting member 36 on the closure member 64. Therefore, as shown in FIG. 8D, the mounting member 36 and the first recess 70 of some embodiments can be configured such that the cross-sectional width 42 of the mounting member 36 is greater than the recess width 100 of the first recess 70, thereby impeding passage of the mounting member 36 through the first recess 70 when the mounting member is at least partially rotated relative to the connector 20.

Further, the closed perimeter 102 of the closed end 94 of the first recess 70 can be configured to define a diameter 104 that is greater than the largest dimension of the cross-section of the mounting member 36. Thus, the mounting member 36 can be configured to move freely within the closed perimeter 102 of the closed end 94 of the first recess 70, while being unable to pass through the narrowed portion of the first recess 70 unless the mounting member 36 is oriented in a proper orientation relative to the first recess 70.

In additional embodiments, it is contemplated that the mounting member 36 can be configured to move within the closed end 94 of the first recess 70 so as to be captured or engaged within the closed end 94. For example, the mounting member 36 could be snapped into place within the closed end 94, pushed into a press fit, or pushed beyond a one-way motion limiting mechanism that allows the mounting member 36 to enter the closed end 94 but reduces or prevents movement of the mounting member 36 out of the closed end 94 or contact with the closure member 64.

Figure 9:
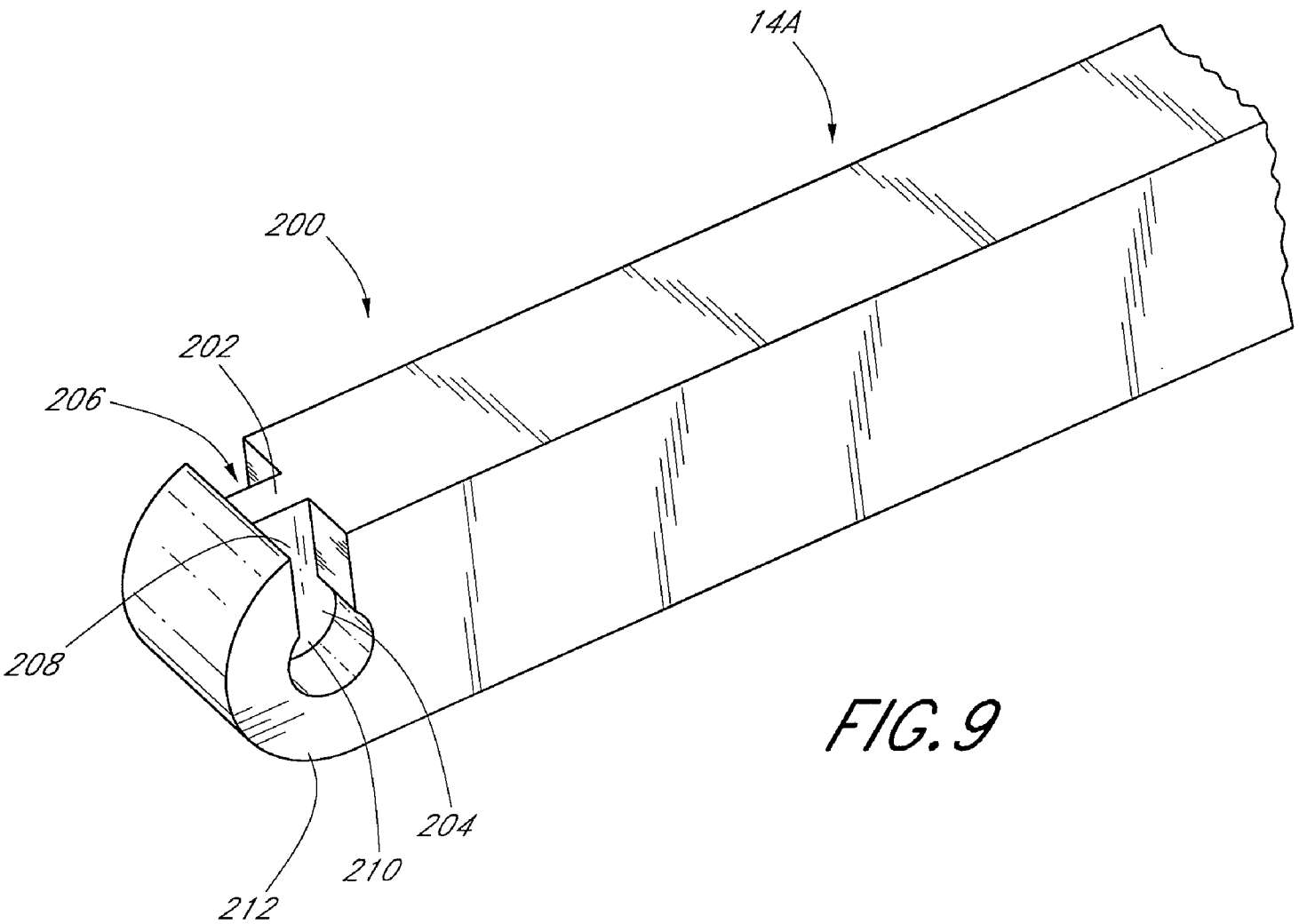
FIG. 9 is a perspective view of another connector that is integrally formed with a rib of the canopy support frame and includes a reinforcing rib and a pair of recesses, in accordance with another embodiment.

Referring now to FIG. 9, a perspective view of another embodiment of a connector 200 is shown. The connector 200 can be integrally or separately formed from a support rib. However, FIG. 9 illustrates the connector 200 being integrally formed with a rib 14A. The connector 200 differs from the connector 20 discussed above in that the connector 200 does not include the closure member 64. Instead, the connector 200 illustrates an embodiment in which a specifically configured recess and a specifically configured mounting member can be used to secure the connector 200 to a structure. Thus, the closure member 64 is optional.

As shown in FIG. 9, the connector 200 can include a reinforcing rib 202, a first recess 204, and a second recess 206. As discussed similarly above, the first and second recesses 204, 206 can be configured such that a first portion 208 thereof defines a narrow geometry through which a mounting member can be passed towards a second portion 210 having a larger geometry into which the mounting member can be received. The geometry of the second portion 210 can be internal or closed in some embodiments. Therefore, as discussed similarly above, a mounting member can be received into the respective ones of the first and second recesses 204, 206. Further, upon relative rotation of the mounting member within the second portion 210 of the recess 204, egress of the mounting member from the second portion 210 can be reduced and/or prevented.

Additionally, as similarly mentioned above, the first portion 208 of the recess 204 can be configured such that it defines a narrower width than the smallest cross-sectional dimension of the mounting member. An embodiment can be provided in which the mounting member could be pressed and urged through an elastically-deforming first portion 208 of the recess 204 until the mounting member is received into the second portion 210 of the recess 204. In this regard, the first portion 208 of the recess 204 could then rebound to its original narrower width, which can be smaller than the largest cross-sectional dimension of the mounting member. In such embodiment, the mounting member could be rotated relative to the connector 200 within the second portion 210 of the recess 204 such that the width of the mounting member, as seen from the first recess 204 is much greater and therefore impossible to allow passage through the first recess 204.

In such embodiments, the mounting member can be securely retained within the recess. Further, the reinforcing rib 202 can also serve to distribute forces throughout the connector 200 that would otherwise result in a bending moment about an elbow section 212 of the connector 200. These and other advantages and features can be incorporated into various other embodiments as taught and disclosed herein. Further, it is noted that where reference is made to only one or both of the recesses, such features can be equally applied for a single or both recesses.

Figure 10:
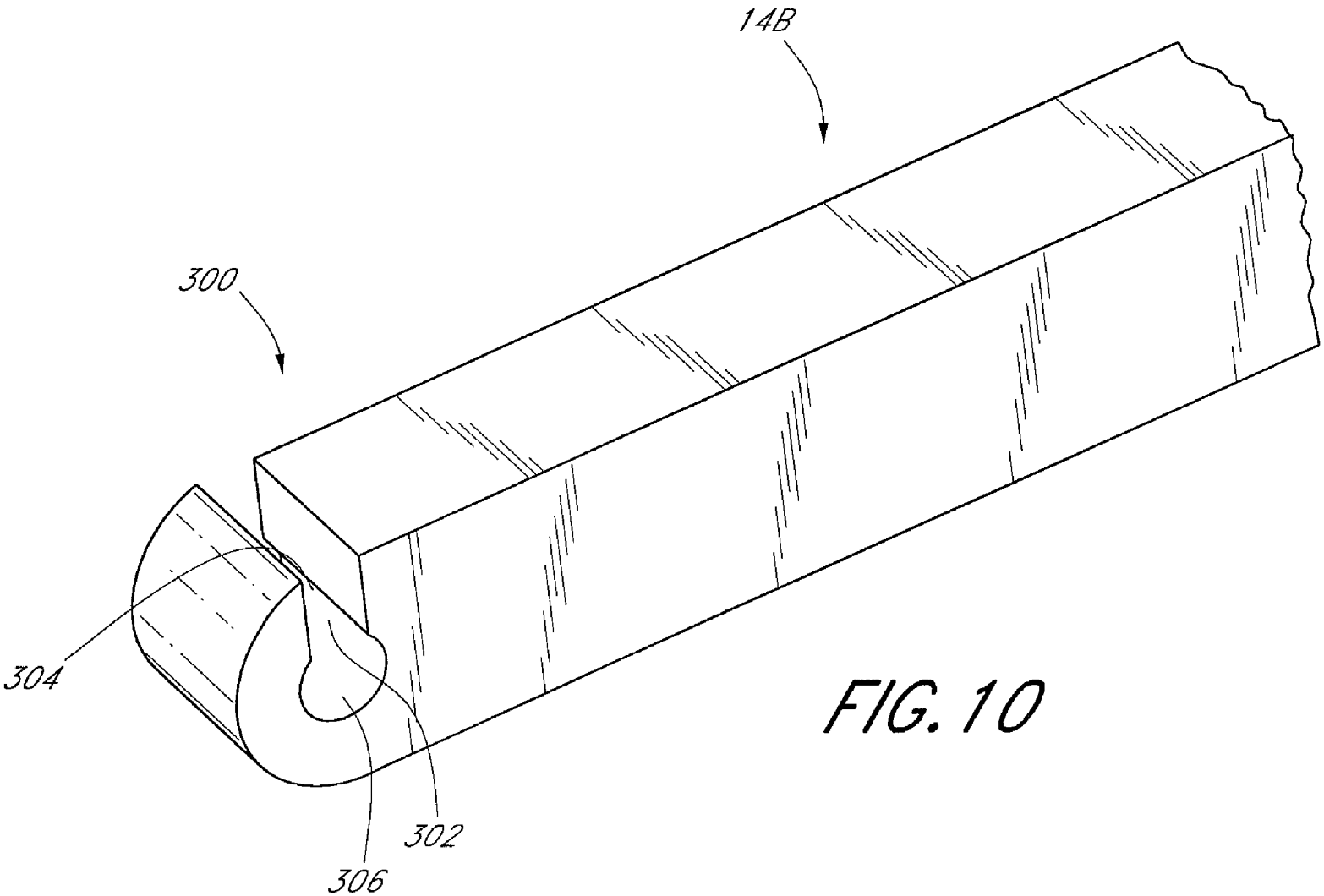
FIG. 10 is a perspective view of another connector that is integrally formed with a rib of the canopy support frame, in accordance with another embodiment.

FIG. 10 is a perspective view of yet another embodiment of a connector 300. The connector 300 can be integrally or separately formed from a support rib. FIG. 9 illustrates the connector 200 being integrally formed with a rib 14B. The connector 300 differs from the connector 20 and 100 discussed above in that the connector 300 does not include the reinforcing rib 66, 202. The connector 300 illustrates an embodiment in which a specifically configured recess and a specifically configured mounting member can be used to secure the connector 300 to a structure. Further, the connector 300 also can be configured to omit the closure member 64, although the closure member 64 is optional. Thus, in some embodiments, it is contemplated that connector 20 can be configured without the reinforcing rib 66 to produce the connector 300.

As mentioned above with respect to FIG. 9, the connector 300 of FIG. 10 can include a recess 302 that can be configured such that a first portion 304 thereof defines a narrow geometry through which a mounting member can be passed towards a second portion 306 having a larger geometry into which the mounting member can be received. The geometry of the second portion 306 can be internal or closed in some embodiments. Therefore, as discussed similarly above, a mounting member can be received into the recess 302. Further, upon relative rotation of the mounting member within the second portion 306 of the recess 302, egress of the mounting member from the second portion 210 can be reduced and/or prevented.

The embodiment illustrated in FIG. 10 can be used with a hub having a pin-type mounting member that spans the width of the engagement section of the hub. In other words, unlike the embodiment of the hub 16 illustrated in FIG. 3A, wherein a pair of mounting members 36 protrude from opposing sides 38 of the engagement section 32, the embodiment of the connector 300 illustrated in FIG. 10 can be used with a single mounting member that is attached to both sides 38 of the engagement section 32. As discussed with respect to the mounting members 36, such a single mounting member can also define a particularized cross-sectional geometry for interacting with the recess 302.

Additionally, as similarly mentioned above, the first portion 304 of the recess 302 can be configured such that it defines a narrower width than the smallest cross-sectional dimension of the mounting member. An embodiment can be provided in which the mounting member could be pressed and urged through an elastically-deforming first portion 304 of the recess 302 until the mounting member is received into the second portion 306 of the recess 302. In this regard, the first portion 304 of the recess 302 could then rebound to its original narrow width, which can be smaller than the largest cross-sectional dimension of the mounting member. In such embodiment, the mounting member could be rotated relative to the connector 300 within the second portion 306 of the recess 302 such that the width of the mounting member, as seen from the recess 302 is much greater and therefore impossible to allow passage through the recess 302. Other features disclosed herein can also be incorporated into the connector 300.

Figure 11:
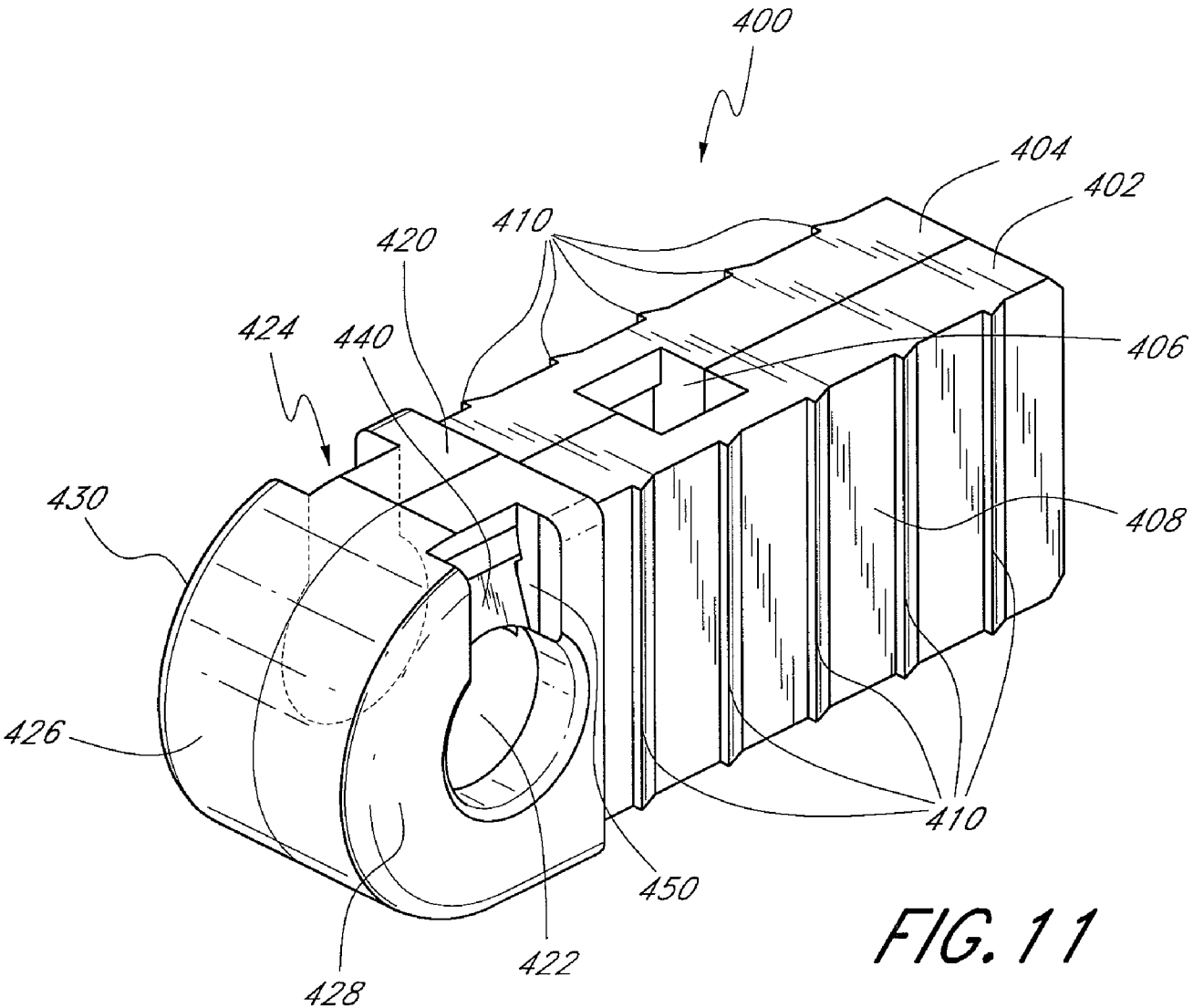
FIG. 11 is a perspective view of another connector having a deflectable closure member that is integrally formed with a portion of the connector.
Figure 12A:
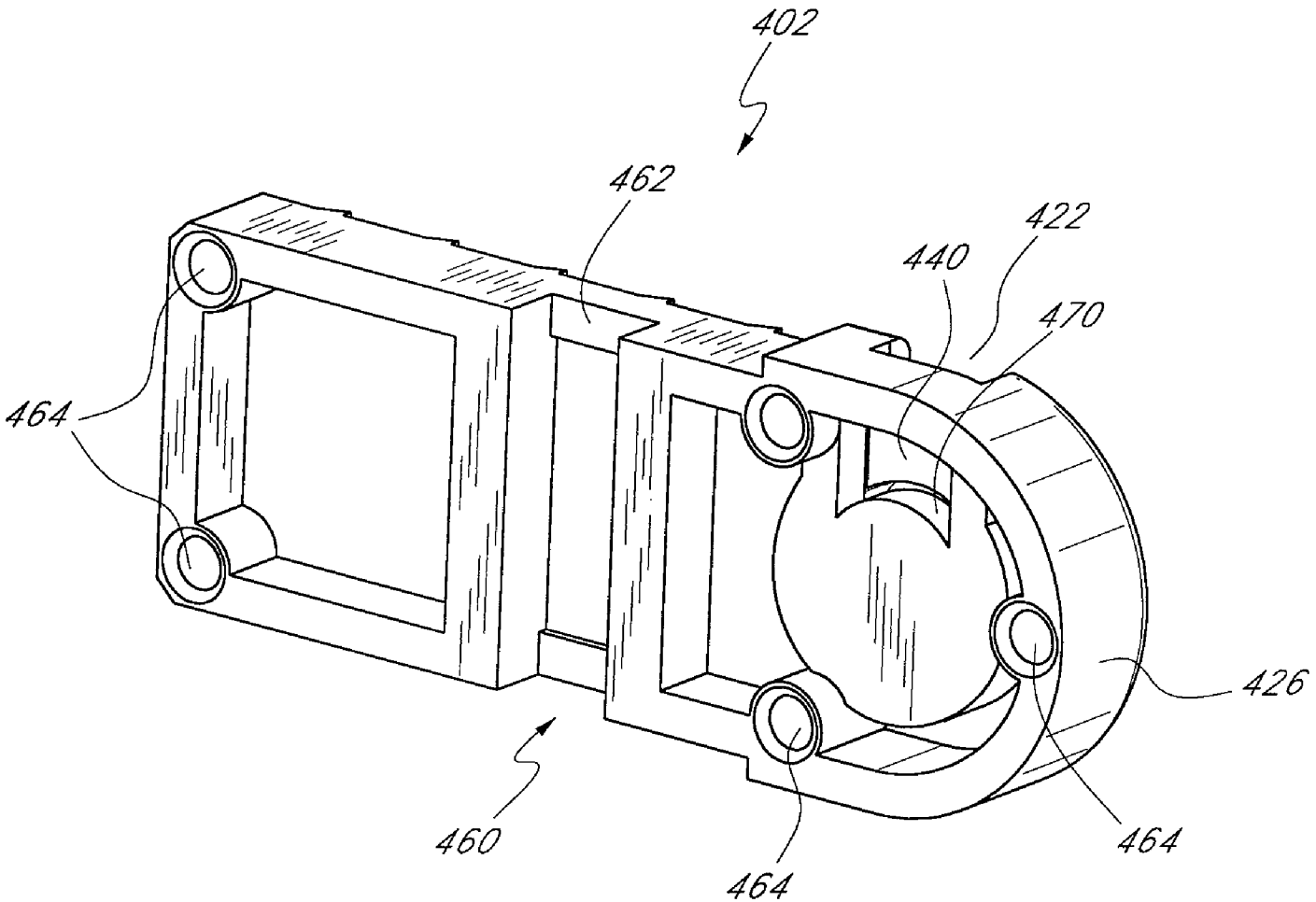
FIG. 12A is an interior perspective view of an interior section of a first half of a connector.
Figure 12C:
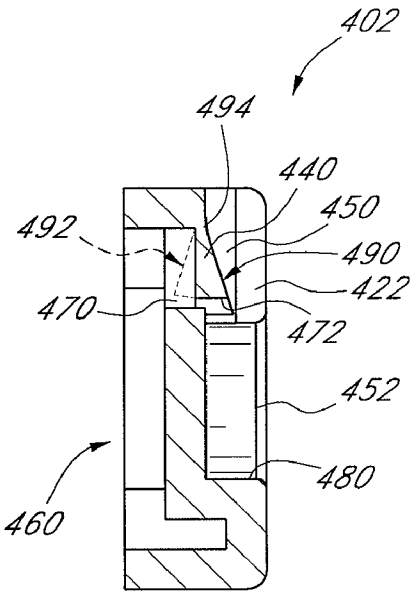
FIG. 12C is a cross-sectional view of the connector of FIGS. 11-12B taken along the section plane 12C-12C.

Referring now to FIGS. 11-12C, another embodiment of a connector 400 is shown. In the illustrated embodiment, the connector 400 can be configured to comprise first and second halves 402, 404. These halves 402, 404 can be manufactured by injection molding and subsequently assembled to form the connector 400. Although it is contemplated that the connector 400 can be assembled from more than two individual pieces, as described further herein, the use of two halves 402, 404 allows the connector 400 to be designed and manufactured in a simple and cost effective manner.

In some embodiments, desired geometric features can also be incorporated into the first and second halves 402, 404 of the connector 400. The connector 400 can be formed with features that facilitate assembly with a rib, such as the rib 14. For example, in the illustrated embodiment of FIGS. 11-12C, the first half 402 can include an interior slot that mates with a corresponding interior slot of the second half 404 such that a central aperture 406 is formed when the halves 402, 404 are joined. The illustrated embodiment shows the aperture 406 as being centrally located on the connector 400; however, the aperture 406 could be closer to one side or the other thereof or placed in any position along the length of the connector 400.

As will be discussed in greater detail below, this feature and others can provide distinct advantages for enhancing the functionality and connectability of the connector 400 with other portions of the umbrella structure.

For example, it is contemplated that in some embodiments, the central aperture 406 can define a cross-sectional size sufficient to allow an attachment means to secure the connector 400 to a distal end of a support rib. The support rib can be similar to other support ribs discussed herein, e.g., support ribs 14 or 500. In some embodiments, the support rib can comprise an extruded hollow bar or tube. As with some other embodiments of the connector, a distal end of the hollow support rib can be configured to receive at least a portion of a proximal section 408 of the connector 400. As used herein "distal" describes a location closer to an umbrella pole with which such a rib is connected and proximal describes a location farther from the umbrella pole. For example, the distal end of the rib discussed herein is similar to the second end 50 of the rib 14.

Once the proximal section 408 of the connector 400 is received to within the distal end of the support rib, an attachment means, such as a screw, bolt, a crimping of a portion of the distal end of the support rib, or other such fasteners or methods can be used to engage the distal end of the support rib with the central aperture 406 of the connector 400. Thus, relative movement between the connector 400 and the distal end of the support rib can be restricted and/or eliminated and the connector 400 can be more securely attached to the distal end of the support rib.

In one embodiments, a crimping machine can create an indentation on an exterior surface of the support rib to secure the connector to the support rib. For example, once the proximal section 408 is received within the distal end of a support rib made of metal or another deformable material, the crimping machine can create an indentation in the rib corresponding to the location of the central aperture 406. The indentation can be made on an exterior surface of the support rib, such as on the distal end of the support rib, and can project inwardly towards the interior of the support rib to thereby engage the central aperture 406. In other embodiments, indentations can be made that correspond to a plurality of apertures similar to the central aperture 406, which are formed on the connector 400 and distributed in a variety of configurations as desired by the manufacturer. Such an embodiment can simplify the manufacturing of the umbrella because it requires fewer parts, such as screws and bolts. Thus, the manufacturability of the umbrella structure and connector are therefore improved.

Additionally, as shown in FIG. 11, other embodiments of the connector 400 can include one or more protrusions 410 disposed along the proximal section 408 of the connector 400 for facilitating the interconnection of the proximal section 408 of the connector 400 with the distal end of the support rib. In some embodiments, the protrusions 410 can extend generally vertically along sides of the proximal section 408 of the connector 400. The protrusions 410 can define wedge-like geometries that tend to allow one-way movement of the connector 400 when received within the distal end of the support rib.

In some embodiments, the protrusions 410 aid in maintaining the connection of the connector 400 to the support rib by engaging one or more apertures disposed in the exterior surface of the distal end of the support rib. Furthermore, it is contemplated that the distal end of the support rib can also be received within an interior passage of the connector 400 if so desired and configured. Such an arrangement could enhance the connection of the connector 400 to the support rib. Nevertheless, the embodiment illustrated in FIG. 11 allows for the two halves 402, 404 to be generally held together by virtue of the compressive force exerted upon the two halves 402, 404 when the proximal section 408 is received to within the distal end of the support rib. Thus, various designs and interactive geometries can be utilized to ensure that the proximal section 408 of the connector 400 is securely received within the distal end of the support rib. In some cases, the support rib can provide a force or coupling at least two components of the connector 400 together.

In accordance with the embodiment of the connector 400 illustrated in FIG. 11, the connector 400 can include a reinforcing rib 420 disposed between first and second recesses 422, 424. As discussed above with respect to other embodiments, the reinforcing rib 420 can be integrally connected to at least a portion of the proximal section 408 and a distal section 426 of the connector 400. In addition, a pair of shoulders 428, 430 can also be formed in the distal section 426 of the connector 400. Further, the first and second recesses 422, 424 can be configured to provide a geometric interconnection with the mounting members of the hub, as similarly described above.

Furthermore, in some embodiments, the connector 400 can further comprise a closure member 440 that can be disposed in a first portion 450 of the first recess 422. As discussed further herein, another closure member can be disposed in a first portion of the second recess 424. In some embodiments, a plurality, e.g., two, closure members can be disposed symmetrically relative to a longitudinal plane of the closure member 440, e.g., the plane along which the halves 402, 404. For purposes of simplicity, only the closure member 440 will be described. Any description of the closure member 440 can equally be applied to another closure member disposed in the first portion of the second recess 424 in embodiments where two closure members are used.

Referring still to the embodiment shown in FIG. 11, passage of the mounting member through the first recess 422 can cause the closure member 440 to deflect and subsequently rebound to an extended or blocking position when the mounting member is seated within a second portion 452 of the recess 422. In some embodiments, the closure member 440 can be hingedly coupled to the first half 402 of the connector 400 such that the closure member 440 can pivot about an axis parallel to a longitudinal axis of the connector 400. For example, the closure member 440 can be hingedly attached to a side surface of the first portion 450 of the recess 422 that is parallel to the longitudinal axis. However, in other embodiments, the closure member 440 can be hingedly coupled to the first half 402 such that the closure member 440 can pivot about an axis transverse to the longitudinal axis of the connector 400. For example, the closure member 440 can be hingedly attached to a side surface of the first portion 450 of the recess 422 that is transverse to the longitudinal axis.

In some embodiments, the closure member 440 can be integrally formed with the connector 400. In such embodiments, the connector 400 can be fabricated from a resilient material, such as a plastic, composite, etc. in order to provide "rebound" or "return" of the closure member 440 from a deflected position to an undeflected position.

For example, the integral construction and material choice of the closure member 440 can enable the closure member 440 to deflect inwardly from an initial undeflected, extended or blocking position when a mounting member enters the first portion 450 of the first recess 422 and makes contact with the closure member 440. Once the mounting member passes through the first portion 450 of the first recess 422 and into the second portion 452 of the first recess 422, the closure member 440 can then rebound or return to its initial undeflected position so as to block or restrict access of the mounting member to the first portion 450 of the first recess 422. When captured inside the second portion 452 of the first recess 422, the mounting member may exert some force against the closure member 440. However, such force will be exerted radially and not in a direction to deflect the closure member 440 to a recessed or collapsed position.

Figure 12B:
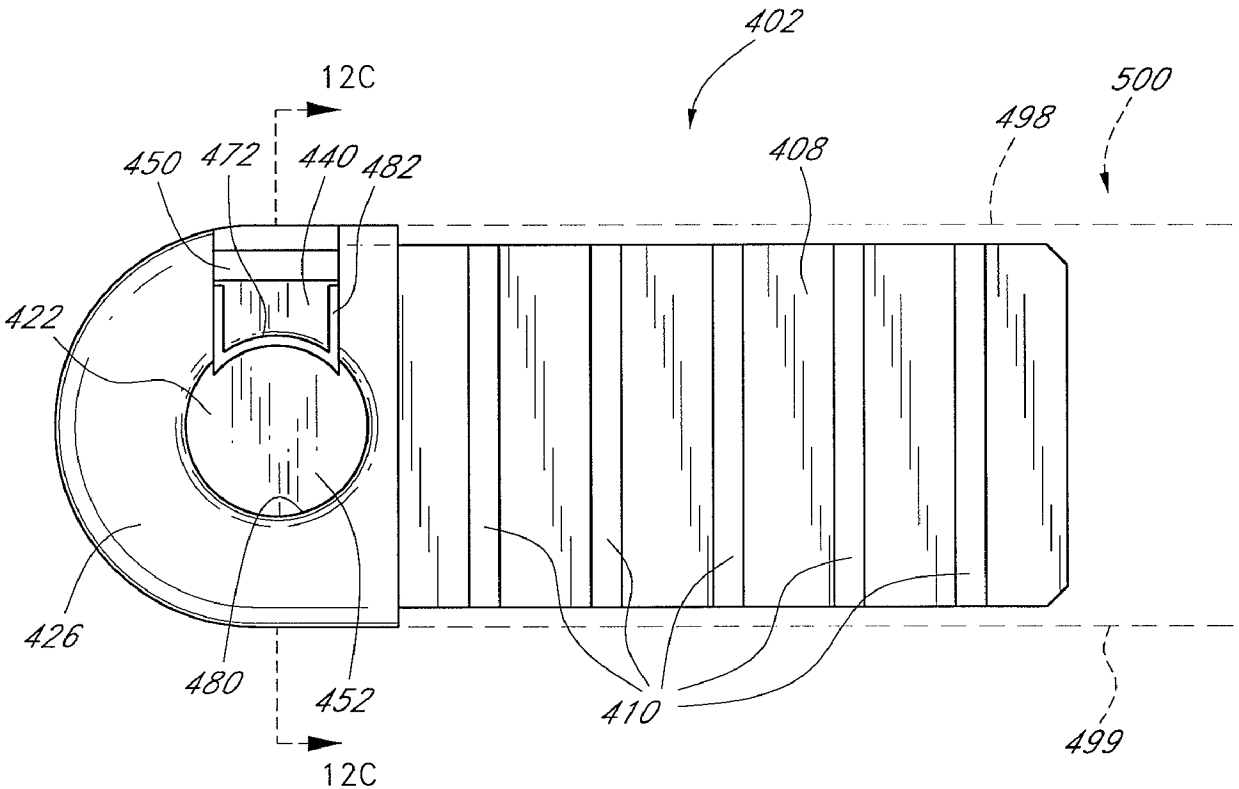
FIG. 12B is a side view of a rib having the connector of FIG. 11 coupled to an end of the rib, in accordance with an embodiment.

Referring now to FIGS. 12A-C, the first half 402 of the connector 400 is illustrated. FIG. 12A is an interior perspective view of an interior section 460 of the first half 402. As described above, in some embodiments the interior section 460 can include a slot 462 that passes vertically through the first half 402 (and a corresponding slot can be disposed through the second half 404) such that when the first half 402 is mated with the second half 404, the central aperture 406 discussed above, is formed.

As also described above, the interior section 460 can be configured to include a plurality of similar slots and/or configurations that can collectively or individually form other features when the first half 402 is paired with the second half 404. Furthermore, a plurality of connection holes 464 are also illustrated in the first half 402. The connection holes 464 can be used to facilitate the interconnection of the first half 402 with the second half 404. In some embodiments, the second half 404 can include corresponding connection pins that protrude from the interior section of the second half 404 and are configured to engage the connection holes 464 of the first half 402.

In addition, FIG. 12A also illustrates that the interior section 460 of the first half 402 can be configured such that the closure member 440 can move within an interior cavity 470. Thus, the closure member 440 can pivot from an extended or blocking position to the recessed or collapsed position within the interior cavity 470 without interference from other portions of the connector 400.

Further, as discussed above, the connector 400 can further comprise other parts or elements, such as a resilient member that urges the closure member 440 from its recessed or collapsed position to its extended or blocking position. Thus, the closure member 440 can be contacted by a resilient member such as a spring or other element in order to urge the closure member 440 to the recessed or collapsed position when the mounting member passes through the first portion 450 of the first recess 422. The resilient member can be a spring or other element.

The closure member 440 is illustrated as being a flap-like member connected at its upper end to the surface of the first portion 450 of the first recess 422 and deflectable, as described above. In other embodiments the closure member 440 can be a spring loaded or can include or be coupled with a separate biased mechanism that selectively extends or retracts from the first portion 450 of the first recess 422 in a sideways manner to permit or restrict access or egress of the mounting member to or from the second portion 452 of the first recess 422.

Referring now to FIG. 12B, a side view of the first half 402 of the connector 400 is shown. As illustrated therein, the closure member 440 can be configured to compliment the circular geometry of the second portion 452 of the first recess 422. The closure member 440 can be separated from other portions of the distal section 426 of the first half 422 of the connector 400 by a gap 482. Further, a lower edge 472 of the closure member 440 can be arcuately formed, thereby facilitating the movement, e.g., pivotal or rotational movement, of a mounting member when disposed within the second portion 452 of the first recess 422. The lower edge 472 of the closure member 440 can work cooperatively with an interior side wall 480 of the second portion 452 of the first recess 422 to contain the mounting member. Though described variously herein as having a circular configuration, the recess 422 can be other arcuate shapes such as oval or oblong, or other non-arcuate shapes such as polygonal or any other suitable shape. Also, the closure member 440 and the lower edge 472 can have a corresponding shape, e.g., arcuate, grooved or substantially straight.

As discussed above, some embodiments where the mounting member includes a specific cross-sectional geometry that can facilitate capture of the mounting member within the second portion 452 of the recess 422. The embodiment of the connector illustrated in FIGS. 11-12C can enable the connector 400 to capture the mounting member by means of such a geometric interaction as well as by the function of the closure member 440.

FIG. 12C illustrates a cross-sectional view of the first half 402 of the connector 400 taken along the lines 12C-12C in FIG. 12B. As illustrated therein, the closure member 440 is shown in solid lines in its extended or blocking position 490. Further, as illustrated in dashed lines, the closure member 440 can be pivoted or deflected from the extended or blocking position 490 to the recess or collapsed position 492. As discussed above, the closure member 440 can pivot or be deflected into the interior cavity 470 of the interior section 460 when moved to the recessed or collapsed section 492.

As also illustrated in FIG. 12C, the closure member 440 can define a substantially triangular cross-sectional shape. Nevertheless, other shapes, connection points of the closure member 440 to the recess 422, and degrees of relative protrusion into the first portion 450 of the first recess 422 are also contemplated. For example, the closure member 440 can be wedge-like in one embodiment. The closure member 440 is preferably configured such that its lower edge 472 can properly contain and/or restrain movement of the mounting member to remain within the second portion 452 of the first recess 422.

Further, FIG. 12C illustrates that the closure member 440 can be coupled to the first half 402 of the connector 400 by a hinge joint 494. As briefly described above, the hinge joint can be integrally formed with the connector 400 and the closure member 440 and can be fabricated from a substantially resilient material that allows the closure member 440 to be deflectable at the hinge joint 494 to the recessed or collapsed position 492 and to return to its extended or blocking position 490. The hinge joint 494 also could be such that the member 440 rotates about a pivot or other mechanism that enables rotation. In other embodiments the closure member 440 is not hingedly connected to the connector 400. In such embodiments, a resilient member, such as a spring or other biasing mechanism can be disposed within the interior cavity 470 and extend into the first portion 450 of the first recess 422. As such, the closure member 440 could be translatable to allow passage of the mounting member into the second portion 452 of the first recess 422 by deflecting or being urged into the interior cavity 470. Such a closure member also can be extendable into the first portion 450 of the first recess 422 to prevent egress of the mounting member from the first recess 422.

Referring again to FIG. 12B, the protrusions 410 can be spaced at equal increments along the proximal section 408 of the first half 402 of the connector 400. The proximal section 408 can also be configured to define a narrower cross-sectional profile than the distal section 426 of the first half 402 of the connector 400. Thus, when the proximal section 408 is received to within a distal portion 498 of a support rib 500 (both shown in hidden lines), an exterior surface of the support rib 500 can be substantially flush with an exterior surface of the distal section 426 of the connector 400 at the junction of the distal section 426 of the connector 400 and the distal end of the support rib 500.

In another embodiment, a connector assembly is provided for connecting a first load bearing member of a shade structure to a second load bearing member of the structure. The connector can comprise a support post and a connector. The support post can be coupled with the second load bearing element and the connector can be attachable thereto. In some embodiments, the support post can have a first dimension in cross-section and a second dimension being oriented generally perpendicularly relative to the first dimension. In this regard, the second dimension can be greater than the first dimension.

In addition, the connector can comprise a first end and a second end. The first end can be capable of being mechanically coupled with the first load bearing member. The second end can comprise a recess extending from a side of the connector. The recess can comprise an open end and a closed end. The open end of the recess can have a first width being greater than the first dimension of the support post and less than the second dimension of the support post. Further, the closed end of the recess can have a second width greater than both the first and second dimensions such that the connector can rotate relative to the support post when the support post is in the closed end. In this regard, the support post can define a cross-section similar to that of the mounting member 36 shown in FIGS. 8B-8D. As discussed above, the cross-section can be configured in a variety of geometric configurations.

In this regard, the first width of the open end of the recess can be configured so as to permit the support post to be inserted through the open end of the recess and into the closed end when the second width of the support post is generally longitudinally aligned with the open end. Further, the first width can prevent the support post from being removed from the closed end when the second width of the support post is generally longitudinally misaligned with the open end.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A connector assembly for connecting a first load bearing structure of a shade structure to a second load bearing structure, the connector assembly comprising:

support posts coupled with the second load bearing structure, the support posts having a first dimension in cross-section and a second dimension perpendicular to the first dimension, the second dimension being greater than the first dimension; and a connector capable of being coupled to the first load bearing structure for coupling the first load bearing structure to the support posts of the second load bearing structure, the connector comprising:

a first end capable of being mechanically coupled with the first load bearing structure; and a second end capable of being mechanically coupled with the support post of the second load bearing structure, the second end comprising:

first and second recesses extending from a first side of the connector toward a second side of the connector, each recess comprising an open end and a closed end, the open end having a first width being greater than the first dimension of the support post and less than the second dimension of the support post, the closed end having a second width greater than both the first and second dimensions such that the connector can rotate relative to the support post when the support post is in the closed end, the first width of the open end permitting the support post to be inserted through the open end and into the closed end when the second width of the support post is generally longitudinally aligned with the open end and preventing the support post from being removed from the closed end when the second width of the support post is generally longitudinally misaligned with the open end;

first and second shoulders formed in the connector between the first and second recesses and a distal end surface of the connector and the second side of the connector, the first and second shoulders extending upwardly from the second side toward the first side of the connector, the first and second shoulders being configured to engage a respective support post to maintain the support post in the respective recess of the connector when attached;

a reinforcing rib formed in the connector between respective side surfaces of the first and second recesses, the reinforcing rib extending along the first side of the connector and separating the first recess from the second recess to define a width that is less than the width of the connector, the reinforcing rib being monolithically formed with the first and second shoulders to couple the first and second shoulders to the first end of the connector for enhancing the structural strength of the connector; and closure members for retaining the support posts in the first and second recesses.

2. The connector of claim 1, wherein the recess includes a channel section having a generally constant width.

3. The connector of claim 1, wherein the second width defines a diameter of a perimeter of the closed end.

4. A connector capable of connecting a first portion of a shade structure to another portion of the structure, the connector comprising:

a first end capable of being mechanically coupled with the first portion;

a second end comprising first and second recesses and a reinforcing rib formed in the connector between the first and second recesses, the first and second recesses extending from respective first and second openings adjacent to a first side of the connector toward a second side of the connector, the first and second recesses defining respective first and second shoulders, the first and second shoulders being formed monolithically with the reinforcing rib along the first side of the connector for enhancing the structural strength of the connector, the first and second openings being configured to receive mounting members of the other portion of the shade structure, the first and second shoulders being configured to rest on or retain the mounting members, the mounting members having a first dimension in cross-section and a second dimension perpendicular to the first dimension, the second dimension being greater than the first dimension, the first and second recesses each comprising an open end and a closed end, the open end having a first width being greater than a first dimension of the mounting member and less than a second dimension of the mounting member to prevent rotation of the mounting member when in the open end, the closed end having a second width greater than both the first and second dimensions such that the connector can rotate relative to the mounting members when the mounting members are in the closed ends of the first and second recesses, the first width of the open end permitting the mounting member to be inserted through the open end and into the closed end when the second width of the mounting member is generally longitudinally aligned with the open end and preventing the mounting member from being removed from the closed end when the second width of the mounting member is generally longitudinally misaligned with the open end; and closure members disposed in the first and second recesses adjacent to the first and second openings thereof, the closure members being disposed on opposing sides of the reinforcing rib, the closure members being movable relative to the reinforcing rib from a first position in which access to the first and second recesses is provided through the respective first and second openings to a second position in which the closure members extend into the first and second recesses blocking access through the first and second openings to the respective first and second recesses.

5. The connector of claim 4, wherein the closure member moves in a path generally transverse to a longitudinal axis of the connector.

6. The connector of claim 4, wherein the closure member is pivotally coupled to the first end of the connector and pivots about an axis that is generally parallel to a longitudinal axis of the connector.

7. The connector of claim 4, wherein the closure member and the connector are formed from a continuous piece of material.

8. The connector of claim 4, wherein the connector comprises first and second longitudinally symmetric halves, the first and second halves each comprising interior slots that collectively form a central aperture when the first and second halves are joined together, the central aperture being engagable by a fastener to attach the connector to the first portion of the shade structure.

9. The connector of claim 8, wherein the first and second halves of the connector can be inserted into a hollow end of the first portion of the shade structure to be coupled thereto.

10. The connector of claim 8, wherein the first and second halves of the connector comprise one or more protrusions configured to engage the first portion of the shade structure.

11. A connector capable of connecting a first portion of a shade structure to another portion of the shade structure, the connector comprising:

a first end capable of being mechanically coupled with the first portion;

a second end capable of being mechanically coupled with the other portion of the shade structure, the second end comprising first and second recesses and a reinforcing rib formed in the connector between the first and second recesses, the first and second recesses defining respective first and second shoulders, the first and second shoulders being formed monolithically with the reinforcing rib along a first side of the connector for enhancing the structural strength of the shoulders, the first and second openings being configured to receive mounting members of the other portion of the shade structure, the first and second recesses configured to receive the mounting members therein in a given orientation and to prevent the mounting members from exiting therefrom unless the mounting members are in the given orientation; and closure members extending from the reinforcing rib into the first and second recesses, the closure members being pivotable along an axis that is parallel to a longitudinal axis of the connector to allow the mounting members to enter the respective first and second recesses and to selectively prevent the mounting members from exiting the respective first and second recesses, the closure members being manually deflectable into the reinforcing rib for permitting the mounting members to exit the respective first and second recesses.

12. The connector of claim 11, wherein the closure members are monolithically formed with the reinforcing rib.

13. The connector of claim 11, wherein the mounting members have a first dimension in cross-section and a second dimension perpendicular to the first dimension, the second dimension being greater than the first dimension, the first and second recesses each comprising an open end and a closed end, the open end having a first width being greater than a first dimension of the mounting member and less than a second dimension of the mounting member to prevent rotation of the mounting member when in the open end, the closed end having a second width greater than both the first and second dimensions such that the connector can rotate relative to the mounting members when the mounting members are in the closed ends of the first and second recesses, the first width of the open end permitting the mounting member to be inserted through the open end and into the closed end when the second width of the mounting member is generally longitudinally aligned with the open end and preventing the mounting member from being removed from the closed end when the second width of the mounting member is generally longitudinally misaligned with the open end.

* * * * *